US007160147B1

(12) United States Patent
Stephan

(10) Patent No.: US 7,160,147 B1
(45) Date of Patent: Jan. 9, 2007

(54) ELECTRICAL CONNECTION SYSTEM

(76) Inventor: Gerard D. Stephan, 13284 County Highway 60, Upper Sandusky, OH (US) 43351

( * ) Notice: Subject to any disclaimer, the term of this patent is extended or adjusted under 35 U.S.C. 154(b) by 0 days.

(21) Appl. No.: 11/400,565

(22) Filed: Apr. 7, 2006

(51) Int. Cl.
*H01R 13/73* (2006.01)

(52) U.S. Cl. ..... 439/535; 174/60

(58) Field of Classification Search ..... 439/535, 439/516, 441, 107; 174/50
See application file for complete search history.

(56) References Cited

U.S. PATENT DOCUMENTS

| | | | | |
|---|---|---|---|---|
| 3,707,697 | A * | 12/1972 | Izumi | 439/107 |
| 4,165,443 | A * | 8/1979 | Figart et al. | 174/53 |
| 4,958,048 | A | 9/1990 | Bell | |
| 5,399,806 | A | 3/1995 | Olson | |
| 5,471,012 | A * | 11/1995 | Opel | 174/53 |
| 5,516,298 | A * | 5/1996 | Smith | 439/131 |
| 6,194,657 | B1 * | 2/2001 | Gretz | 174/53 |
| 6,227,903 | B1 * | 5/2001 | Horton | 439/535 |
| 6,309,248 | B1 * | 10/2001 | King | 439/535 |
| 6,435,903 | B1 * | 8/2002 | Nelson | 439/528 |
| 6,617,511 | B1 | 9/2003 | Schultz | |
| 6,830,477 | B1 * | 12/2004 | Vander Vorste et al. | 439/535 |
| 6,870,099 | B1 | 3/2005 | Schultz | |
| 6,884,111 | B1 * | 4/2005 | Gorman | 439/535 |
| 6,940,016 | B1 * | 9/2005 | Cornett et al. | 174/58 |
| 7,052,313 | B1 * | 5/2006 | Gorman | 439/535 |
| 2004/0161956 | A1 * | 8/2004 | Lubkert | 439/107 |

* cited by examiner

*Primary Examiner*—Tulsidas C. Patel
*Assistant Examiner*—Phuongchi Nguyen
(74) *Attorney, Agent, or Firm*—Gallagher & Dawsey Co., LPA; David J. Dawsey; Michael J. Gallagher

(57) ABSTRACT

An electrical connection system designed to connect electrical conductors to a junction box containing a receptacle. The system incorporates a junction box, a supply connector, a distribution connector, and a receptacle. The junction box includes a line bus, a ground bus, and a neutral bus. The supply connector adapts the incoming electrical wire having a line conductor, a ground conductor, and a neutral conductor for connection to the line bus, the ground bus, and the neutral bus. The electrical receptacle is formed with a line blade, a ground blade, and a neutral blade which, respectively, electrically connect to the line bus, the ground bus, and the neutral bus. Electrical energy may be supplied through the electrical conductors to the electrical receptacle. A distribution connector may be incorporated to supply electrical energy to downstream receptacles.

20 Claims, 16 Drawing Sheets

ELECTRICAL CONNECTION SYSTEM

TECHNICAL FIELD

The instant invention relates to installation systems for connecting electrical wiring to electrical receptacles, and, more particularly, to an electrical connection system having a supply connector, a junction box, and a receptacle, that provides a system for installing electrical receptacles in a quick, safe, and inexpensive fashion.

BACKGROUND OF THE INVENTION

The most common method of installing electrical wiring and receptacles is by manually connecting each wire to its corresponding terminal on a receptacle. During the construction of many buildings and residential homes, installation of electrical wiring precedes finishing of the walls. Generally, electrical installations proceed in three stages. First, a plurality of junction boxes are installed where electrical receptacles will eventually be located. In a second stage, individual wires or multiple wires housed in a sheath are pulled through the walls and ceilings to junction boxes from a breaker box or control panel. At each end of each wire pull, excess wire, usually 10 to 12 inches, is left extending through the junction box. Once the electrical wiring is "roughed-in" the electrical installation is usually put on hold while the walls and ceilings are finished. After the wall studs are covered, the electrical installation resumes with the final stage.

The electrician returns to strip any sheathing and insulation from the individual wires and then proceeds to connect the wire to the proper terminals on each receptacle or switch. Once each wire is properly terminated on the receptacle, the receptacle is forced into, and then attached to the junction box. After securing the receptacle to the junction box, a cover plate is attached to the receptacle to prevent objects, such as fingers, from entering between the junction box and the electrical terminals on the receptacle. Once the cover plate is installed, electrically powered appliances may be plugged into the receptacle.

As used in this specification the term wire means any electrically conductive material. The most widely used wire is made of copper, though in some instance aluminum may be used. Wire used in electrical installations is usually insulated. While the wires may be separate, in many installations, for example in residential installations, three or more conductors are bound together as one cable in a protective sheath. Romex NM-B, is a commonly used type of sheathed cable. As previously stated, the sheathed cables contain three or more insulated wires that are encased in another outer covering for additional protection from moisture, heat, and abrasion. Sheathed cable is designated by wire gauge sizes and the number of conductive wires within the sheath. For example, a "14-2" Romex wire is two insulated conductors plus a ground non-insulated conductor enclosed in the sheath. The instant invention is equally successful in connecting sheathed cable and individual wires.

The term receptacle means an arrangement of the three or four conductive wire connections to physically and electrically accept an electrical plug for domestic or industrial use. The plugs may take many physical forms. Most countries have adopted standard plug designs that mate with a corresponding receptacle design. For example, a common plug in the United States is the NEMA 1-5 configuration, though other types having a ground connection, such as NEMA 5-15, are also common. The NEMA 1-15 plug fits the NEMA 1-15, NEMA 5-15, and NEMA 5-20 receptacles in most locations. The plugs may be polarized. Other types of plug/receptacle configurations in common use around the world are a Europlug (CEE 7/16), a JIS 8303 plug/receptacle found in Japan, and BS 4573 plug/receptacle found in England. While the above mentioned plugs/receptacle configurations provide 125 VAC connectivity, other plugs and receptacles, such as NEMA 14-30 and NEMA 14-50, are designed to provide both 125V and 250V AC connectivity. In the United States, the NEMA 14-30 connection is mostly used on electric clothes dryers, and the NEMA 14-50 connection is often used for connecting electric ranges to the appropriate receptacle. In addition, receptacles may be duplex receptacles, GFCI, or AFCI type receptacles.

The drawbacks to manually connecting each wire to a terminal on a receptacle or switch are numerous. The foremost being the great expense. Electrical installations are costly for many reasons, but two reasons predominate. First, an electrician must be involved. Electricians are skilled laborers. Due to the demand for electricians, particularly for the knowledge they possess, they do not work cheaply. Secondly, the amount of time required to complete an electrical installation is great. The majority of the time is spent performing labor intensive tasks. In a residential home, the bulk of the wiring is to convenience receptacles. There may be as many as ten 120V 15A receptacles arranged on a single circuit. Other specialty circuits also exist. For instance, an air conditioner, an electric range, a furnace, an electric water heater, and a sump pump, are usually placed onto a dedicated circuit. With respect to the receptacles and specialty circuits, after the system is designed, the bulk of the time is spent connecting wires to their proper terminals. The process of locating the proper termination point and the terminating each wire is a straightforward, repetitious process.

Beside the cost, other drawbacks to manually terminating each wire are common. One is that the improper termination of wires is an electrical hazard. Improper termination may include connecting the wire to the wrong location, or it may include terminating the wire at the proper location but not fastening the wire tightly enough so that a loose connection results. Potential users of an improperly wired receptacle may be injured. In addition, improper wiring can result in fire.

Also known to installers is insufficient room in the junction box for excess wire length plus the receptacle. During installation excess wire length is pulled through at each junction box. If the installer cuts the wire too short, they will not have enough wire to work with or will have to pull another wire through a finished wall. If the wire is too long, there will not be enough space inside the junction box for the wire and the receptacle.

There remains an unfulfilled need for an electrical connection system which can simplify receptacle installation, and thus reduce installation costs, in commercial and residential buildings. Additionally, there remains an unfulfilled need to provide an electrical connection system which can be used to quickly and easily expand an existing electrical system that does not require an in depth understanding of electrical wiring.

SUMMARY OF INVENTION

In its most general configuration, the present invention advances the state of the art with a variety of new capabilities and overcomes many of the shortcomings of prior devices in new and novel ways. The present invention overcomes the shortcomings and limitations of the prior art in any of a number of generally effective configurations. The instant invention demonstrates such capabilities and overcomes many of the shortcomings of prior methods in new and novel ways.

The present electrical connection system is designed to quickly and inexpensively connect a power supply cable to an electrical load where the power supply cable has an insulating sheath enclosing a line conductor, a ground conductor, and a neutral conductor. The power supply cable is pulled to the location where a junction box is mounted. The electrical connection system has a supply connector housing and a receptacle.

In one embodiment of the instant invention, the junction box is formed with a bus support surface and at least one sidewall having an interior surface and an exterior surface. Three electrically conductive buses are mounted within the junction box, namely: a line bus, a ground bus, and a neutral bus. Another line bus, called a second line bus, may also be positioned within the junction box.

The line bus, the ground bus, and the neutral bus are each formed with a supply prong and a bus blade connector. The second line bus, when present, has a second line bus supply prong and a second line bus blade connector. In one embodiment, the line bus, the ground bus, the neutral bus, and the second line bus penetrate the junction box sidewall passing through the sidewall interior surface and through the sidewall exterior surface such that they protrude from the sidewall exterior surface.

In one embodiment, the supply connector housing may be constructed of a supply connector base and a supply connector clamp. The supply connector base may have a supply base proximal end and a supply base distal end. The supply base proximal end may be formed with a supply line bus prong receiver, a supply ground bus prong receiver, and a supply neutral bus prong receiver. The supply connector base may house a supply line connector, a supply ground connector, and a supply neutral connector.

The supply line connector may have a supply line bus contact end and a supply line conductor contact end. Likewise, the supply ground connector may have a supply ground bus contact end and a supply ground conductor contact end, and the supply neutral connector may have a supply neutral bus contact end and a supply neutral conductor contact end.

When the power supply cable is inserted into the supply cable insertion channel, the line conductor is brought into electrical communication with the supply line conductor contact end, the ground conductor is brought into electrical communication with the supply ground conductor contact end, and the supply neutral conductor is brought into electrical communication with the neutral conductor contact end.

The supply connector clamp may have a supply clamp proximal end and a supply clamp distal end. The supply connector clamp may be fastened to the supply connector base such that the line conductor, the ground conductor, and the neutral conductor are substantially prevented from withdrawing from the supply connector housing.

The supply connector clamp and the supply connector housing may be fastened together. The supply base proximal end and the supply clamp proximal end are then brought into position substantially against the sidewall. The line bus supply prong, the ground bus prong and the neutral bus supply prong enter the line bus supply, the ground bus supply, and the neutral supply prong receiver, respectively. Each of the prongs is in electrical communication with their respective bus prong contact ends.

In one embodiment, the receptacle face is formed with a line prong receiver, a ground prong receiver, and a neutral prong receiver. The receptacle may have a line blade, a ground blade, and a neutral blade. The line prong receiver is in electrical communication with the line blade, the ground prong receiver is in electrical communication with the ground blade, and the neutral prong receiver is in electrical communication with the neutral blade.

When the receptacle is inserted into the junction box, each of the three blades are brought into engagement with the three buses creating electrical continuity from the respective prong receiver to the conductor.

In another embodiment, the junction box includes a supply connector shroud. The supply connector housing may be inserted into the supply connector shroud.

In another embodiment, a power distribution cable is inserted into a distribution connector housing. The power distribution cable may contain a distribution line conductor, a distribution ground conductor, and a distribution neutral conductor. The distribution connector housing may have a distribution connector base and a distribution connector clamp.

The distribution connector base may have a distribution base proximal end and a distribution base distal end. The distribution base proximal end may be formed with three prong receivers. The distribution connector base may house three connectors, specifically: a distribution line connector, a distribution ground connector and a distribution neutral connector.

When the power distribution cable is inserted into the distribution cable insertion channel, the line conductors are inserted into electrical communication with the conductor contact ends. The distribution base proximal end and the distribution clamp proximal end are brought into position substantially against the sidewall. The distribution prongs enter the distribution prong receivers so that the distribution prongs are in electrical communication with the distribution prong contact ends. The system permits distribution of electrical power from one junction box to one or more additional junction boxes. In another embodiment, the system offers connectivity and distribution of four conductors.

The system of the instant invention enables a significant advance in the state of the art. The instant invention is, in addition, widely applicable to a large number of applications. The various embodiments, as would be understood by one skilled in the art, would be suitable to residential and industrial electrical installations. These variations, modifications, alternatives, and alterations of the various preferred embodiments may be used alone or in combination with one another, as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

Figure 1:
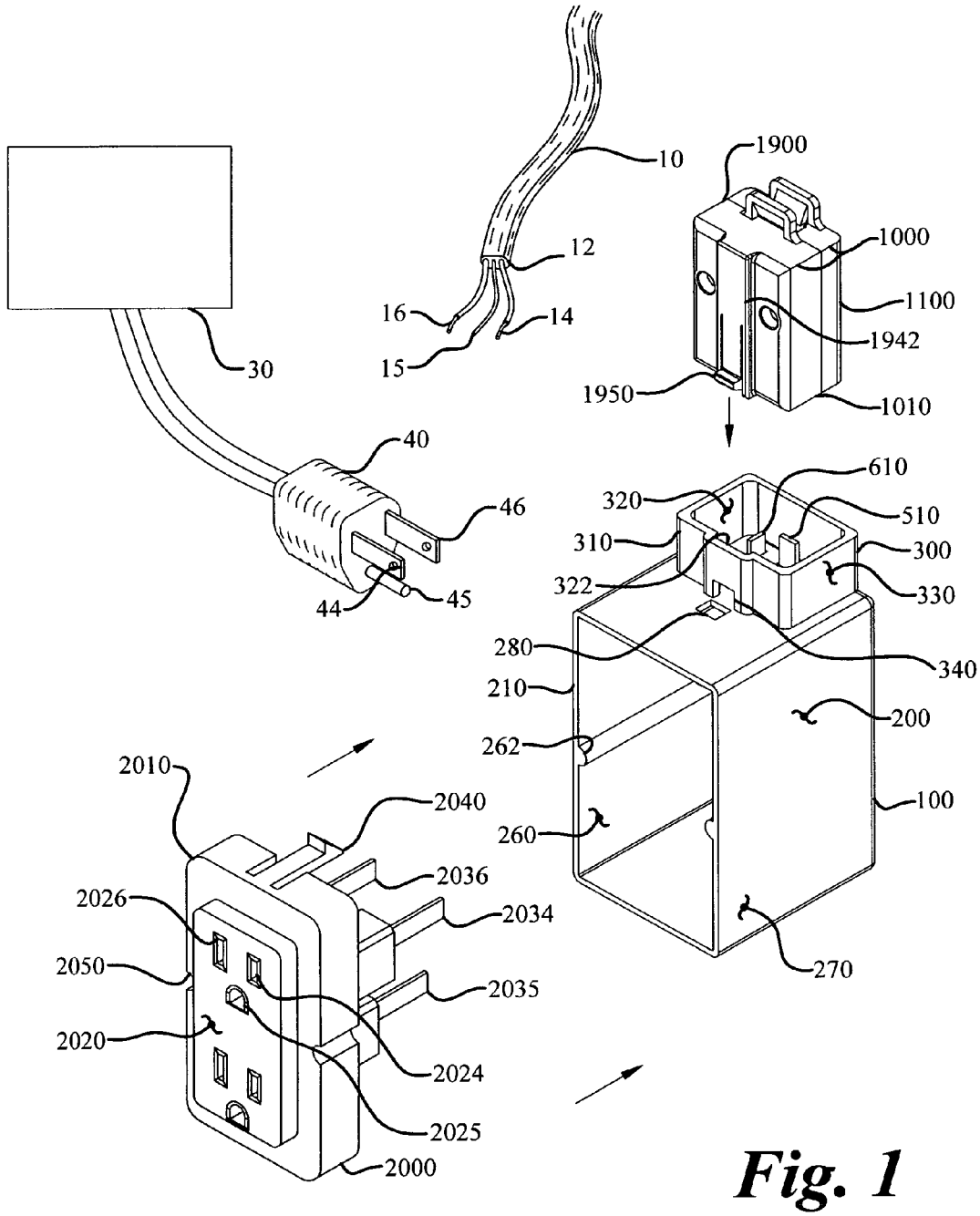
FIG. 1 is an isometric view of an embodiment of the electrical connection system, showing the components of the electrical connection system, not to scale.

The electrical connection system (50) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Referring now generally to FIGS. 1 through 16, the present invention is an electrical connection system (50) designed to quickly and inexpensively connect a power supply cable (10) to an electrical load (30) where the power supply cable (10) has an insulating sheath (12) enclosing a line conductor (14), a ground conductor (15), and a neutral conductor (16), collectively referred to as the "three conductors." And, the electrical load (30) has a plug (40) formed with a line prong (44), a ground prong (45), and a neutral prong (46), collectively referred to as the "three prongs." The power supply cable (10) is pulled to the location where a junction box (100) is mounted. In one embodiment of the instant invention, the electrical connection system (50) has a supply connector housing (1000) and a receptacle (2000), as will be described in more detail below.

Figure 2:
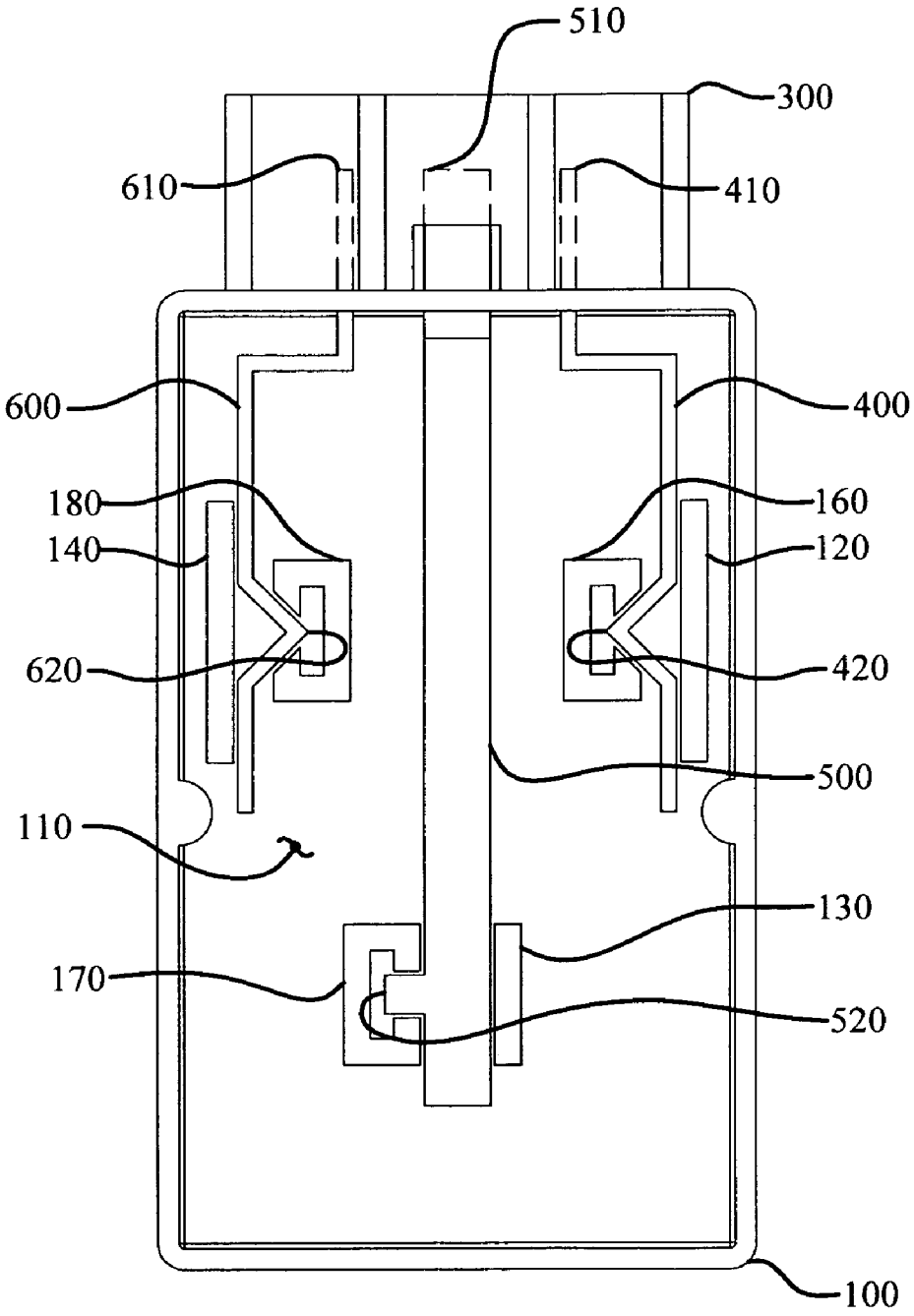
FIG. 2 is an elevation view of an embodiment of the junction box, not to scale.

In one embodiment of the instant invention, the junction box (100) is formed with a bus support surface (110) and at least one sidewall (200) having an interior surface (260) and an exterior surface (270), best seen in FIGS. 1 and 2. As one skilled in the art will observe and appreciate, the junction box (100) may be made of metal or may be nonmetallic, such as PVC or other plastic. Three electrically conductive buses are mounted within the junction box (100). With reference to FIG. 2, a line bus (400), a ground bus (500), and a neutral bus (600), collectively referred to as the "three buses," are mounted within the junction box (100). While the embodiment of the junction box (100), as seen in FIG. 2, has the bus support surface (110) as the back wall of the junction box (100), one skilled in the art will observe and appreciate that the bus support surface (110) may be the sidewall (200) or may be a series of projections extending from the junction box (100) or from the sidewall (200). Furthermore, one skilled in the art will recognize and appreciate, the line bus (400) has a current carrying capacity that meets or exceeds the current carrying capacity of the power supply cable (10). Similarly, the ground bus (500) and the neutral bus (600) have current carrying capacities that meet or exceed the requirements of the circuit in which the electrical connection system (50) is used. Moreover, as one skilled in the art will observe, while the three buses are named with reference generally to industrial nomenclature for three wire single-phase, (sometimes referred to as split phase, two wire Edison, or three phase center tapped) the three buses are electrical conductors and their use is not restricted solely to their reference names. They may be used in a variety of other electrical power installations in which three conductors are needed.

With continued reference to FIG. 2, the line bus (400) is formed with a line bus supply prong (410) and a line bus blade connector (420). Likewise, the ground bus (500) is formed with a ground bus supply prong (510) and a ground bus blade connector (520), and the neutral bus (600) is formed with a neutral bus supply prong (610) and a neutral bus blade connector (620). As seen in FIGS. 1 and 2, in one embodiment of the instant invention, the line bus (400), the ground bus (500) and the neutral bus (600) penetrate the junction box sidewall (200) passing through the sidewall interior surface (260) and through the sidewall exterior surface (270) such that the line bus supply prong (410), the ground bus supply prong (510), and the neutral bus supply prong (610) protrude from the sidewall exterior surface (270).

Figure 3:
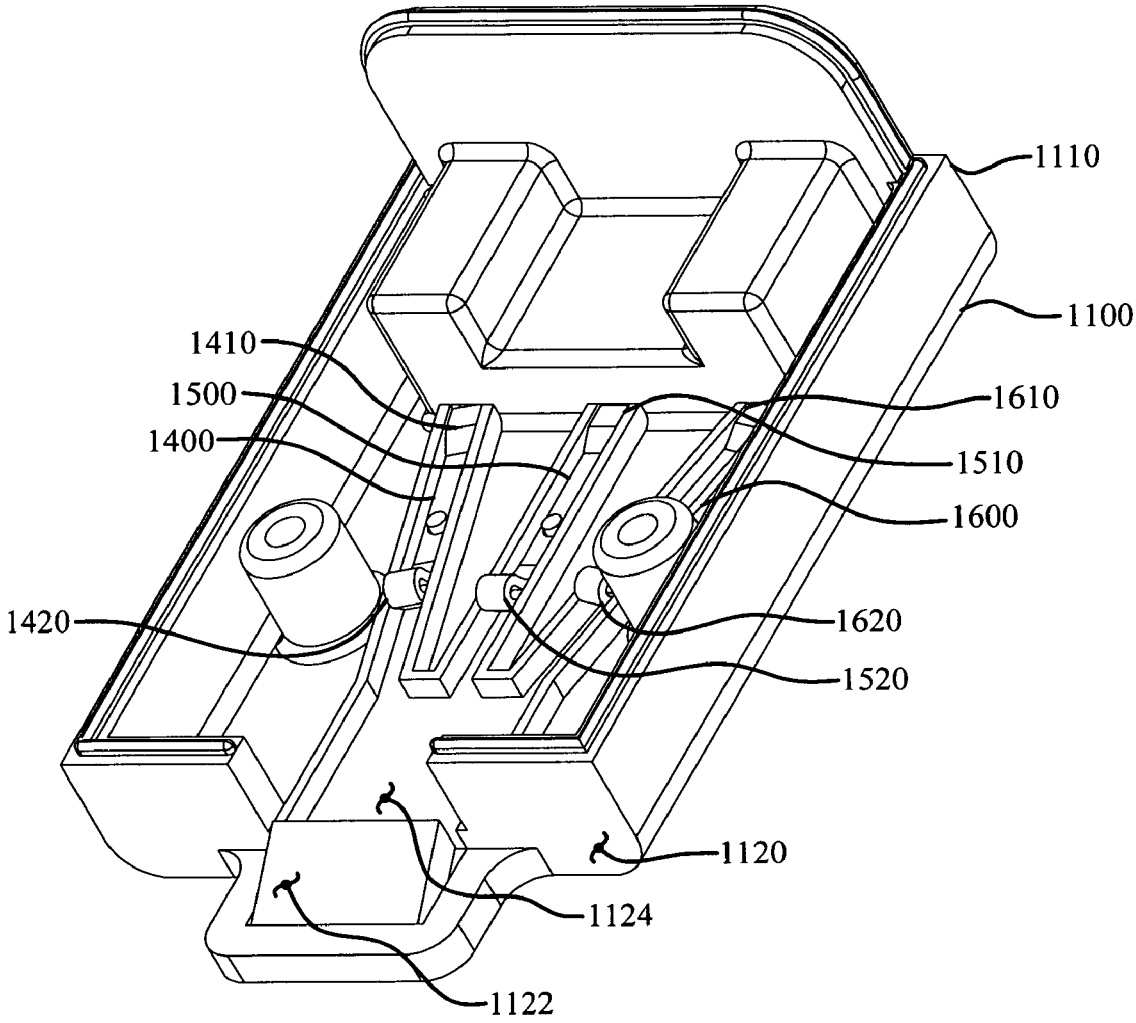
FIG. 3 is an isometric view of an embodiment of the supply connector base, showing components of the connector, not to scale.
Figure 4:
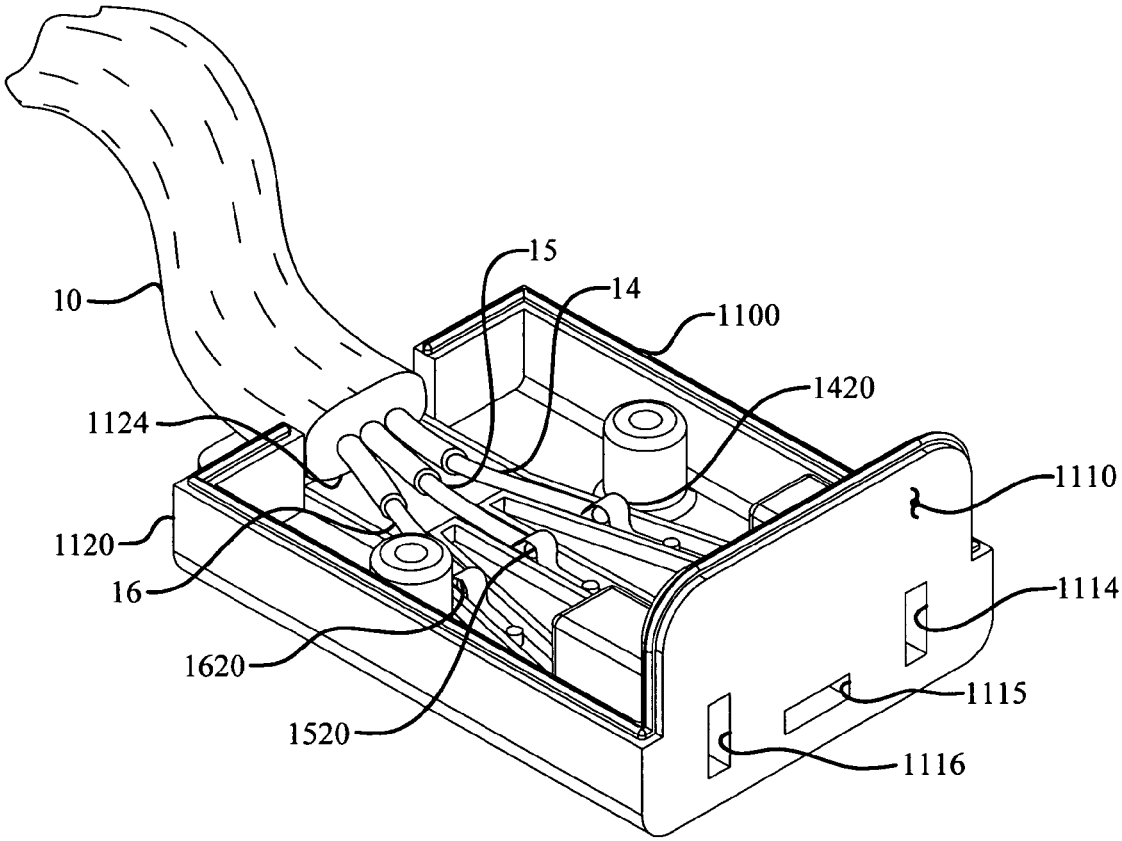
FIG. 4 is an isometric view of an embodiment of the supply connector base, showing connection of the power supply cable, not to scale.
Figure 5:
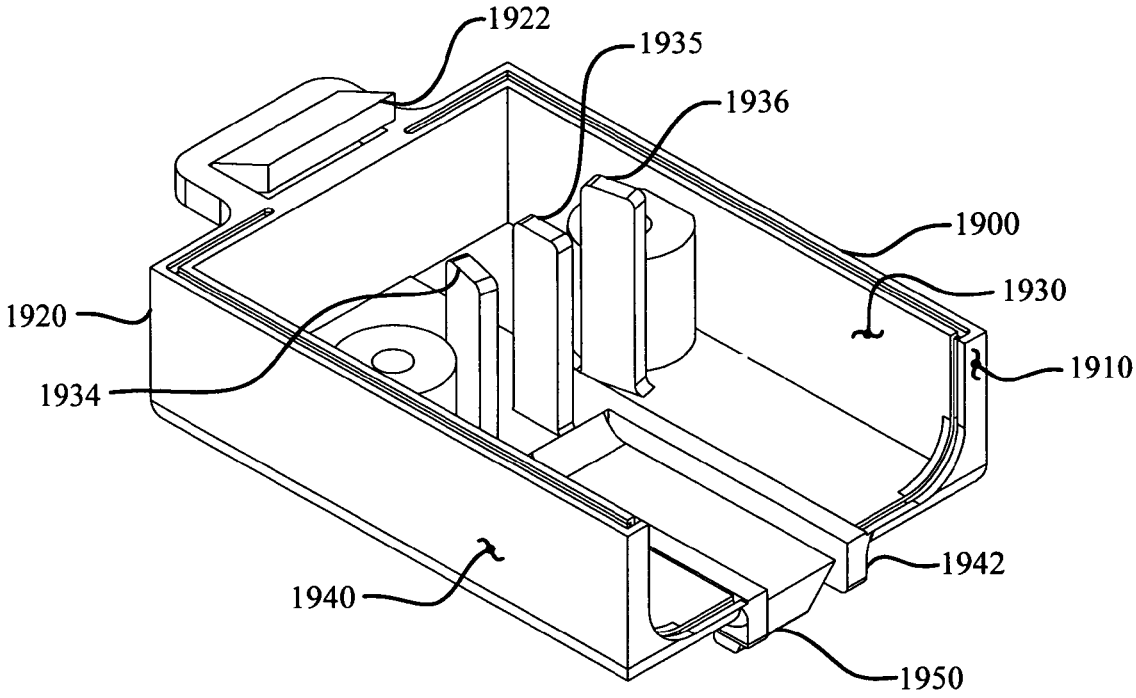
FIG. 5 is an isometric view of an embodiment of the supply connector clamp, not to scale.

In one embodiment of the instant invention, the supply connector housing (1000) may be constructed of two components, namely a supply connector base (1100), seen in FIG. 3, that releasably cooperates with a supply connector clamp (1900), seen in FIG. 5. With specific reference to the one embodiment of FIG. 4, the supply connector base (1100) has a supply base proximal end (1110) and a supply base distal end (1120). The supply base proximal end (1110) is formed with a supply line bus prong receiver (1114), a supply ground bus prong receiver (1115), and a supply neutral bus prong receiver (1116). As seen in FIG. 3, the supply base distal end (1120) is formed with a supply cable insertion channel (1124). In one embodiment, the supply connector base (1100) has a supply connector sheath retainer (1122). The supply connector base (1100) houses a supply line connector (1400), a supply ground connector (1500), and a supply neutral connector (1600), collectively referred to as the "three connectors."

With continued reference to the embodiment of FIG. 3, the supply line connector (1400) has a supply line bus contact end (1410) and a supply line conductor contact end (1420). Likewise, the supply ground connector (1500) has a supply ground bus contact end (1510) and a supply ground conductor contact end (1520), and the supply neutral connector (1600) has a supply neutral bus contact end (1610) and a supply neutral conductor contact end (1620). The supply line bus contact end (1410) substantially aligns with the supply line bus prong receiver (1114), the supply ground contact end (1510) substantially aligns with the supply ground bus prong receiver (1115), and the supply neutral bus contact end (1610) substantially aligns with the supply neutral bus prong receiver (1116). The supply line conductor contact end (1420), the supply ground conductor contact end (1520), and the supply neutral conductor contact end (1620) are substantially aligned with the supply cable insertion channel (1124).

Referring now to FIG. 4, when the power supply cable (10) is inserted into the supply cable insertion channel (1124), the line conductor (14) is brought into electrical communication with the supply line conductor contact end (1420), the ground conductor (15) is brought into electrical communication with the supply ground conductor contact end (1520), and the supply neutral conductor (16) is brought into electrical communication with the neutral conductor contact end (1620).

Figure 6:
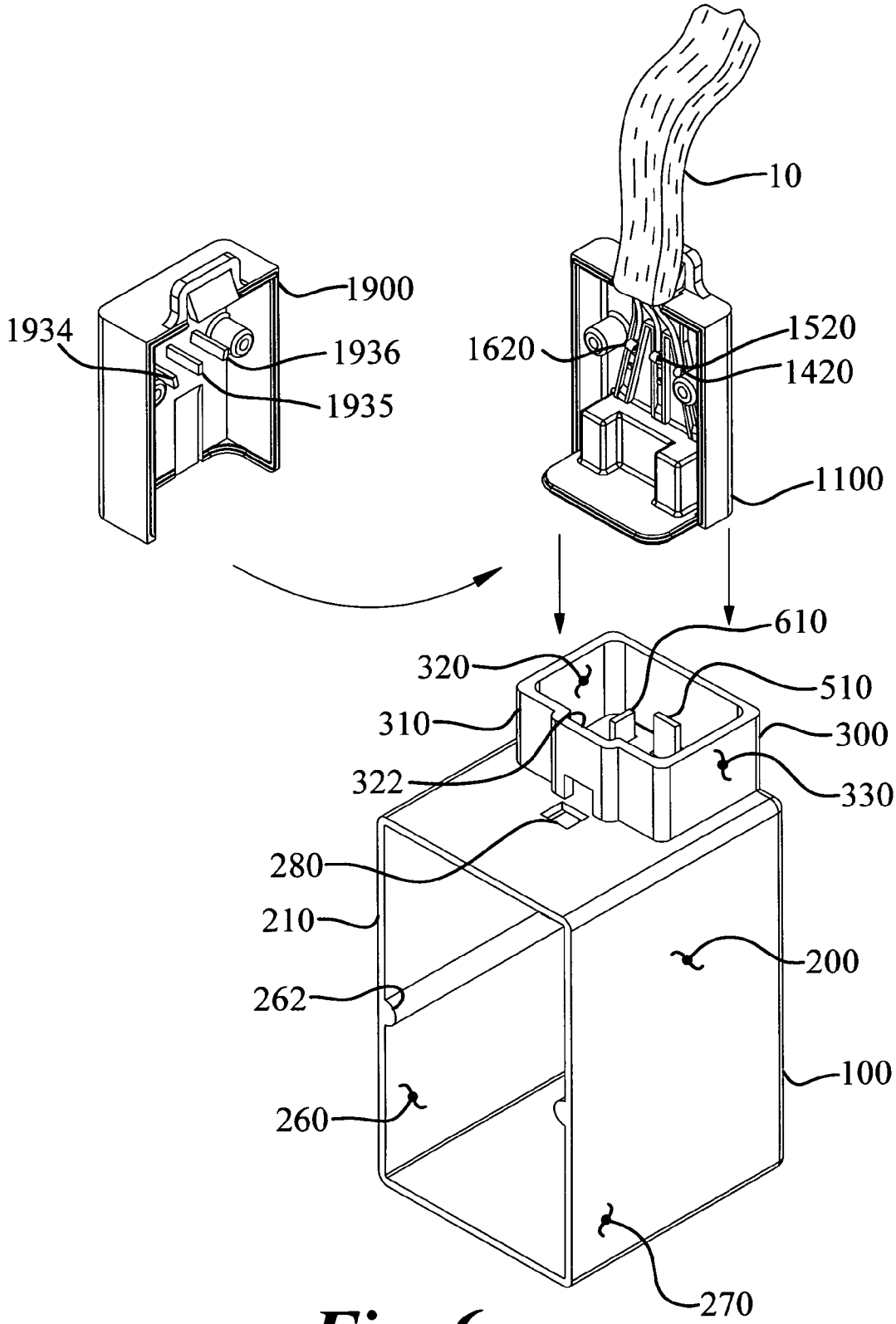
FIG. 6 is an isometric view of an embodiment of the connector housing being assembled for insertion into an embodiment of the junction box, not to scale.

One embodiment of the supply connector clamp (1900) is seen in FIGS. 5 and 6. In this embodiment, the supply connector clamp (1900) has a supply clamp proximal end (1910) and a supply clamp distal end (1920). The supply connector clamp (1900) is releasably attached to the supply connector base (1100) such that the line conductor (14), the ground conductor (15), and the neutral conductor (16) are substantially prevented from withdrawing from the supply connector housing (1000). In one embodiment of the instant invention, as seen in FIG. 5, a means for preventing the withdrawal of the three conductors is provided by a supply line clamp (1934), a supply ground clamp (1935), and a supply neutral clamp (1936). The clamps (1934, 1935, 1936) project from a supply clamp interior surface (1930) and releasably and forcibly engage the contact ends (1420, 1520, 1620). Thus, when the supply connector clamp (1900) is fastened to the supply connector base (1100), as seen in FIG. 6, the supply line clamp (1934) mechanically secures the line conductor (14), the supply ground clamp (1935) mechanically secures the ground conductor (15), and the supply neutral clamp (1936) mechanically secures the neutral conductor (16). The line conductor (14), the ground conductor (15), and the neutral conductor (16) are held in electrical communication with the supply line connector (1400), supply ground connector (1500), and supply neutral connector (1600), respectively. In another embodiment of the supply connector clamp (1900), also seen in FIG. 6, the supply connector clamp (1900) may have a supply sheath retainer (1922) that releasably grips the insulating sheath (12) and may assist in substantially preventing the unintended withdrawal of the power supply cable (10) from the supply connector clamp (1900).

With continued reference to the embodiment of FIG. 6, following insertion of the three conductors into the supply connector housing (1000), the supply connector clamp (1900) and the supply connector base (1100) are fastened together. The supply base proximal end (1110) and the supply clamp proximal end (1910) form a supply connector housing perimeter (1010). While FIGS. 3–6 illustrate the supply connector housing (1000) as split longitudinally such that the proximal ends (1110, 1910) form the perimeter (1010), as one skilled in the art will observe and appreciate, and by way of example and not limitation, the supply connector housing (1000) may be formed from a clamp and a base split laterally, or, alternatively, the supply connector housing (1000) may be a unitary housing with a clamp formed around an interior base. In other, alternative embodiments of the supply connector housing (1000), the supply base proximal end (1010) may simply be the end profile of either the supply connector base (1100) or the supply connector clamp (1900), not both together.

The supply base proximal end (1110) and the supply clamp proximal end (1910) are then brought into position substantially against the sidewall (200) whereby, the line bus supply prong (410) enters the supply line bus prong receiver (1114) so that the line bus supply prong (410) is in electrical communication with the supply line bus prong contact end (1410). Similarly, the ground bus supply prong (510) enters the supply ground bus prong receiver (1115) so that the ground bus supply prong (510) is in electrical communication with the supply ground bus contact end (1510), and the neutral bus supply prong (610) enters the neutral bus prong receiver (1116) so that the neutral bus supply prong (610) is in electrical communication with the supply neutral bus contact end (1610). Thus, once the supply connector housing (1000) is inserted into an installed position, electrical continuity exists between the line conductor (14) and the line bus (400), the ground conductor (15) and the ground bus (500), and the neutral conductor (16) and the neutral bus (600).

Figure 7:
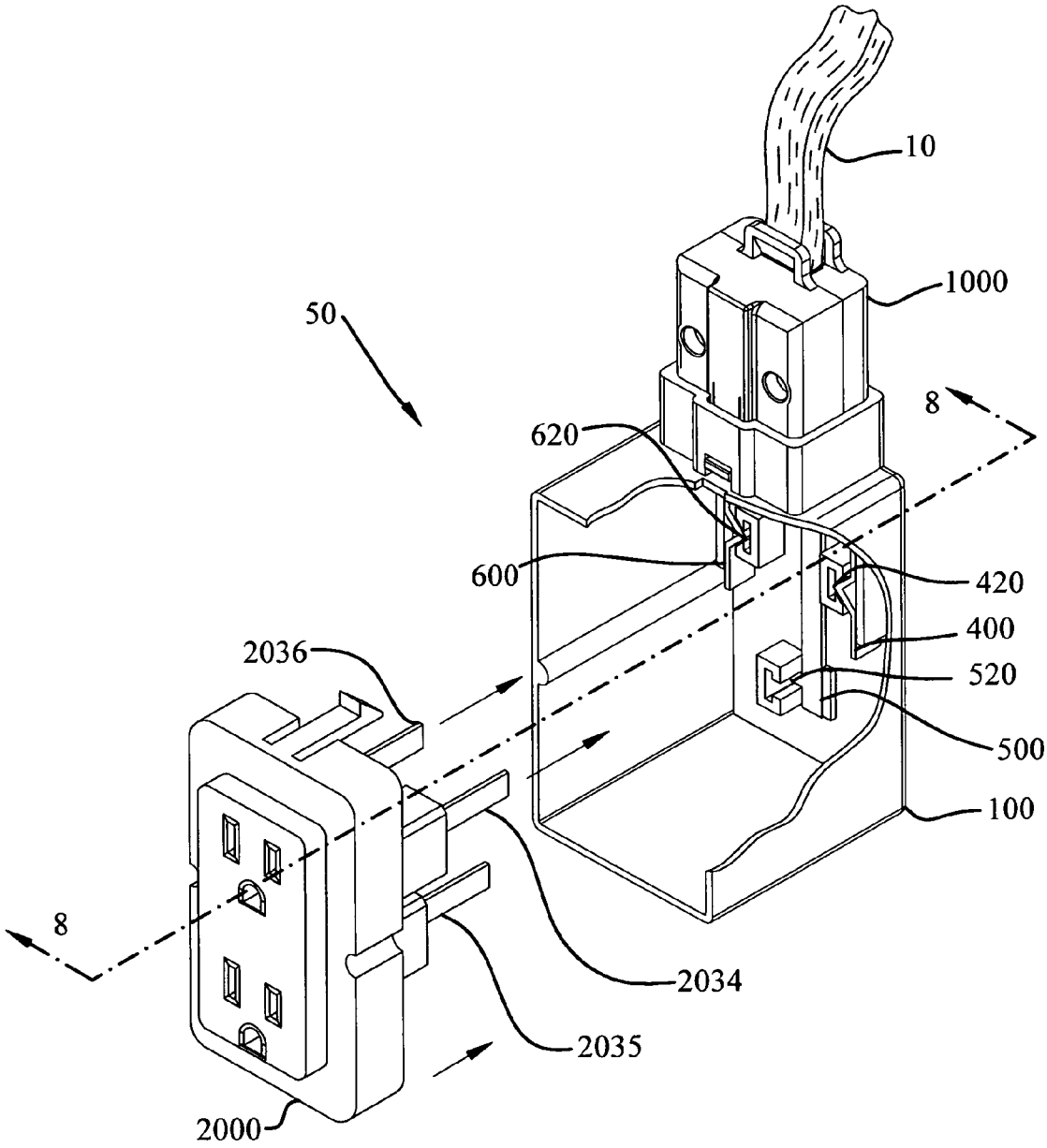
FIG. 7 is an isometric view of an embodiment of the electrical connection system, not to scale, illustrating insertion of an embodiment of the receptacle, not to scale.
Figure 8:
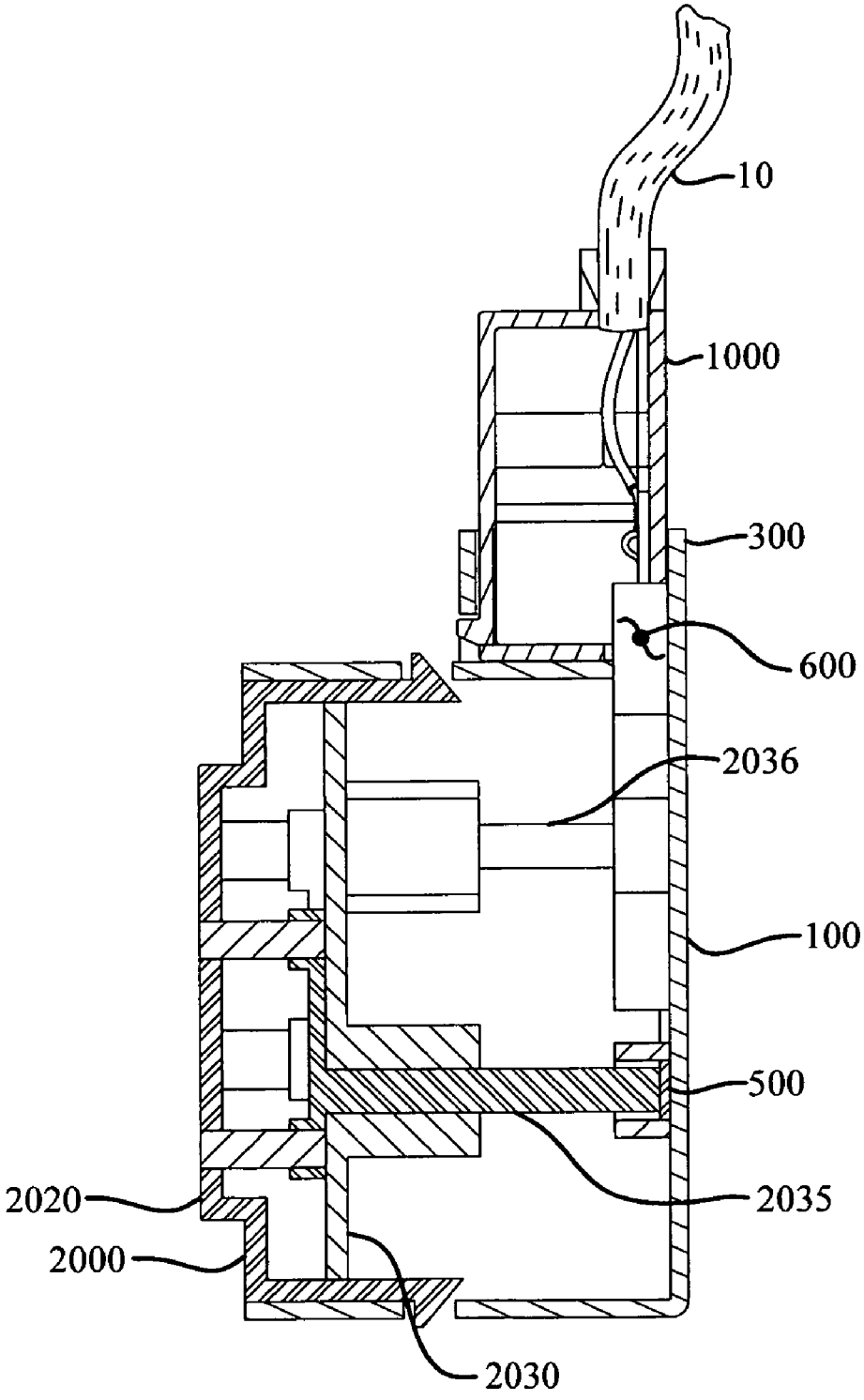
FIG. 8 is a cross-sectional view of an embodiment of the electrical connection system taken along section line 8—8 of FIG. 7, not to scale.

With reference now generally to FIGS. 1, 7, and 8, the receptacle (2000) is formed with a receptacle face (2020) and a receptacle back (2030). As seen in FIG. 1, the receptacle face (2020) is formed with a line prong receiver (2024), a ground prong receiver (2025), and a neutral prong receiver (2026). The arrangement of the line prong receiver (2024), the ground prong receiver (2025), and the neutral prong receiver (2026) is designed to accept the plug (40). Specifically, the line prong (44) is inserted into the line prong receiver (2024), the ground prong (45) is inserted into the ground prong receiver (2025), and the neutral prong (46) is inserted into the neutral prong receiver (2026) simultaneously with one thrust of the plug (40). As previously mentioned, there is a wide variety of prong receiver arrangements. By way of example only, and not limitation, in the United States, a common plug and receptacle type are the NEMA 1-15 and NEMA 5-15 having three conductors in the plug and three corresponding receivers in the receptacle, as seen in FIGS. 1 and 7. As one skilled in the art will observe and appreciate, other types of plugs and receptacles, in the U.S. and in other countries, having three conductors may be used. With continued reference to FIGS. 1 and 7, the receptacle (2000) has a line blade (2034), a ground blade (2035), and a neutral blade (2036), collectively referred to as the "three blades." The line prong receiver (2024) is in electrical communication with the line blade (2034), the ground prong receiver (2025) is in electrical communication with the ground blade (2035), and the neutral prong receiver (2026) is in electrical communication with the neutral blade (2036).

As seen in FIGS. 7 and 8, when the receptacle (2000) is inserted into the junction box (100), each of the three blades (2034, 2035, 2036) are brought into engagement with the three buses (400, 500, 600) creating electrical continuity from the line prong receiver (2024) to the line conductor (14), from the ground prong receiver (2025) to the ground conductor (15), and from the neutral prong receiver (2026) to the neutral conductor (16). Specifically, with reference to FIGS. 1 and 8, the line blade (2034) releasably engages, and is in electrical communication with, the line bus blade connector (420). Likewise, the ground blade (2035) releasably engages, and is in electrical communication with, the ground bus blade connector (520), and the neutral blade (2036) releasably engages, and is in electrical communication with, the neutral bus blade connector (620). Therefore, as one skilled in the art will appreciate, when the plug (40) is inserted into the receptacle (2000), electrical energy may pass through the three conductors (14, 15, 16), through the three buses (400, 500, 600), through the three blades (2034, 2035, 2036), and through the three prongs (44, 45, 46) to power the electrical load (30).

In another embodiment of the instant invention, with reference to FIGS. 1 and 8, the junction box (100) further includes a supply connector shroud (300). As seen in FIG. 1, the supply connector shroud has a supply connector rim (310) having a supply connector interior surface (320) and a supply connector exterior surface (330). The supply connector interior surface (320) may be formed with a connector alignment recess (322). The supply connector shroud (300) may be formed with a supply connector retaining prong catch (340). In addition, as seen in FIG. 5, the supply connector clamp (1900), having a supply clamp exterior surface (1940), may be formed with a supply alignment fixture (1942) and a supply connector retaining prong (1950). The supply alignment fixture (1942) cooperates with the connector alignment recess (322), as seen in FIG. 1, substantially preventing the supply connector housing (1000) from being inserted in an inappropriate orientation. When the supply connector housing (1000) is inserted into the supply connector shroud (300), the supply connector retaining prong (1950) engages the supply connector retaining prong catch (340). Thus, the supply connector housing (1000) is releasably connected to the supply connector shroud (300) substantially preventing the unintended withdrawal of the supply connector housing (1000) from the supply connector shroud (300).

In another embodiment of the instant invention, as seen in FIGS. 2 and 7, the bus support surface (110) is formed with a line bus blade alignment fixture (160), a ground bus blade alignment fixture (170), and a neutral bus blade alignment fixture (180). When the receptacle (2000) is inserted into the junction box (100), each of the three blades (2034, 2035, 2036) is guided into position against one of the three buses. In fact, in the embodiment seen in FIG. 7, each of the three blades (2034, 2035, 2036) is guided into position against one of the connectors (420, 520, 620). As seen in FIGS. 2 and 7, the line blade (2034) releasably engages the line bus blade alignment fixture (160), and the line blade (2034) is held in electrical communication with the line bus blade connector (420) by the line bus blade alignment fixture (160); the ground blade (2035) releasably engages the ground blade alignment fixture (170), and the ground blade (2035) is held in electrical communication with the ground bus blade connector (520) by the ground blade alignment fixture (170); and the neutral blade (2036) releasably engages the neutral blade alignment fixture (180), and the neutral blade (2036) is held in electrical communication with the neutral bus blade connector (620) by the neutral blade alignment fixture (180).

As one skilled in the art will observe and appreciate, the connectors (420, 520, 620) may be flat areas on the buses (400, 500, 600) designed to electrically cooperate with the blades (2034, 2035, 2036). By way of example, and not limitation, in another embodiment of the buses (400, 500, 600), the connectors (420, 520, 620) improve the reliability of the electrical connection between one of the buses (400, 500, 600) and one of the blades (2034, 2035, 2036). In another embodiment of the buses (400, 500, 600), the connectors (420, 520, 620) may be receptacles or openings in the bus (400, 500, 600) that cooperate with one of the blades (2034, 2035, 2036). Conversely, the blades (2034, 2035, 2036) may be formed having a forked or pronged end that engages the bus (400, 500, 600) and electrically connects the blade (2034, 2035, 2036) and the bus (400, 500, 600).

In another embodiment of the instant invention, as seen in FIG. 2, the junction box (100) is formed with a line bus support (120), a ground bus support (130), and a neutral bus support (140). Generally, the line bus support (120) is positioned to support the line bus blade connector (420). The line bus support (120) may enhance the mechanical strength of the line bus (400) and substantially prevents the line bus (400) from flexing out of position when the line blade (2034) is forced into contact with the line bus connector (420). When the line blade (2034) is inserted into position, the line blade (2034) may cause the line bus (400) to bend away from the line blade (2034). The line bus support (120) may substantially prevent deflection of the entire line bus (400), localizing any deformation to the line bus blade connector (420). Similarly, the ground bus support (130) is positioned to support the ground bus blade connector (520) when the ground blade (2035) is inserted into position against the ground bus (500). Finally, the neutral bus support (140) is positioned to support the neutral bus blade connector (620) when the neutral blade (2036) is inserted into position against the neutral bus (600).

Figure 9:
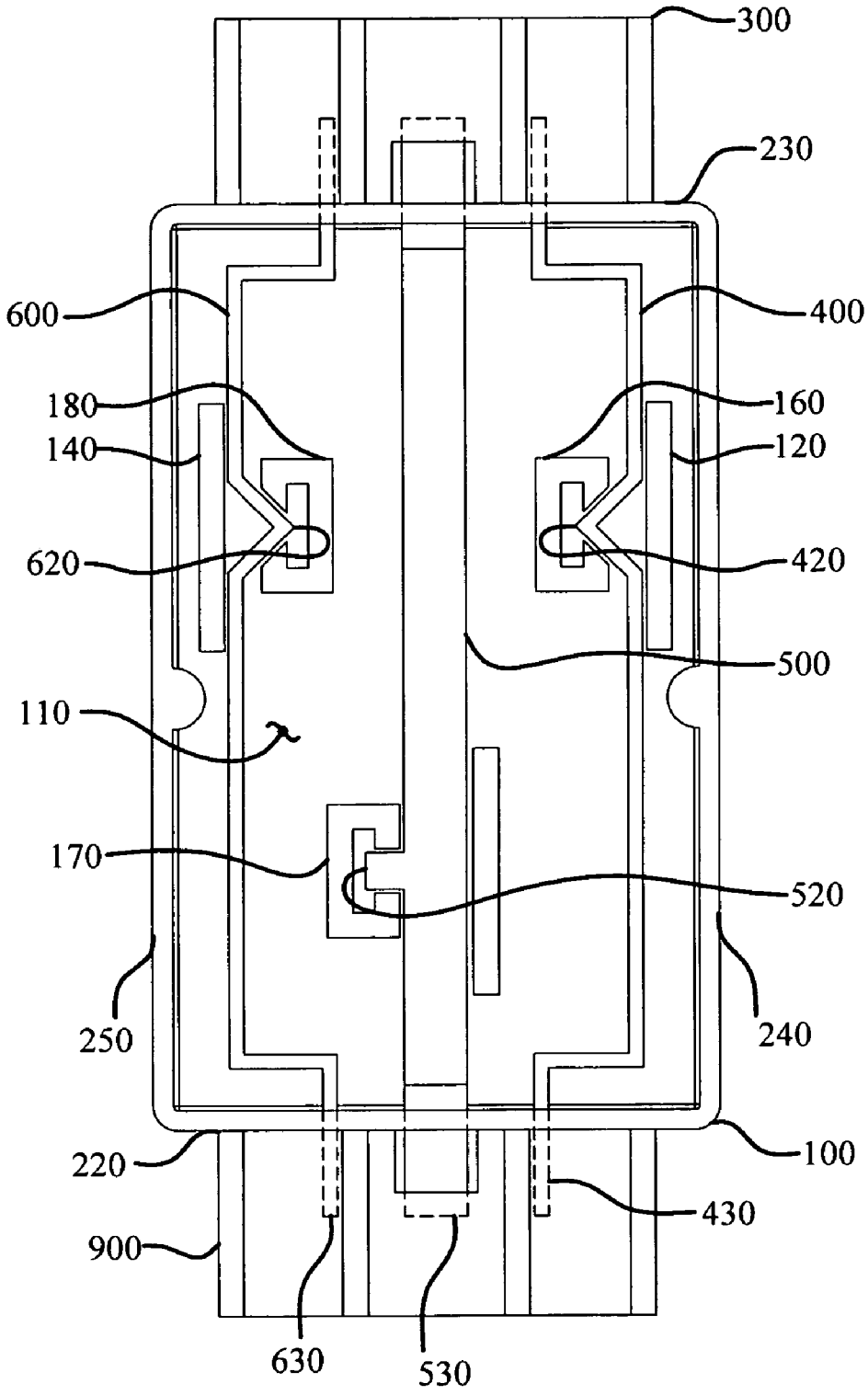
FIG. 9 is an elevation view of an embodiment the junction box, not to scale.

In another embodiment of the instant invention, the system (50) permits distribution of electrical power from one junction box (100) to one or more additional junction boxes (100). In this embodiment, as seen in FIG. 9, the line bus (400) is formed with a line bus distribution prong (430), the ground bus (500) is formed with a ground bus distribution prong (530), and the neutral bus (600) is formed with a neutral bus distribution prong (630). The line bus (400), the ground bus (500), and the neutral bus (600) penetrate the junction box sidewall (200) passing through the sidewall interior surface (260) and through the sidewall exterior surface (270) such that the line bus distribution prong (430), the ground bus distribution prong (530), and the neutral bus distribution prong (630) protrude from the sidewall exterior surface (270).

Figure 10:
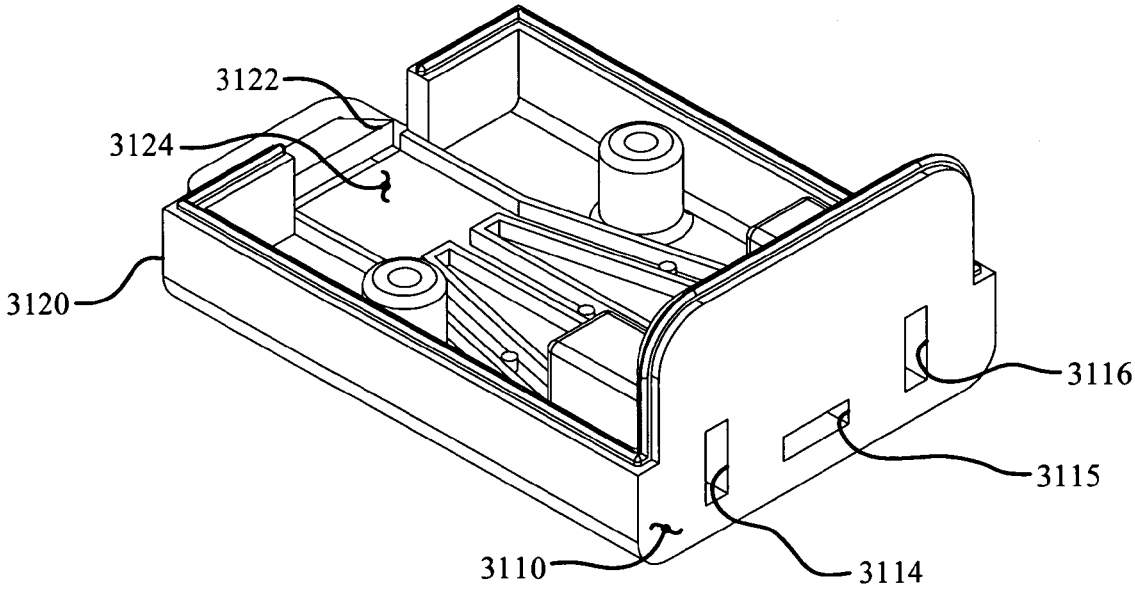
FIG. 10 is an isometric view of an embodiment of the distribution connector base, showing components of the connector, not to scale.
Figure 11:
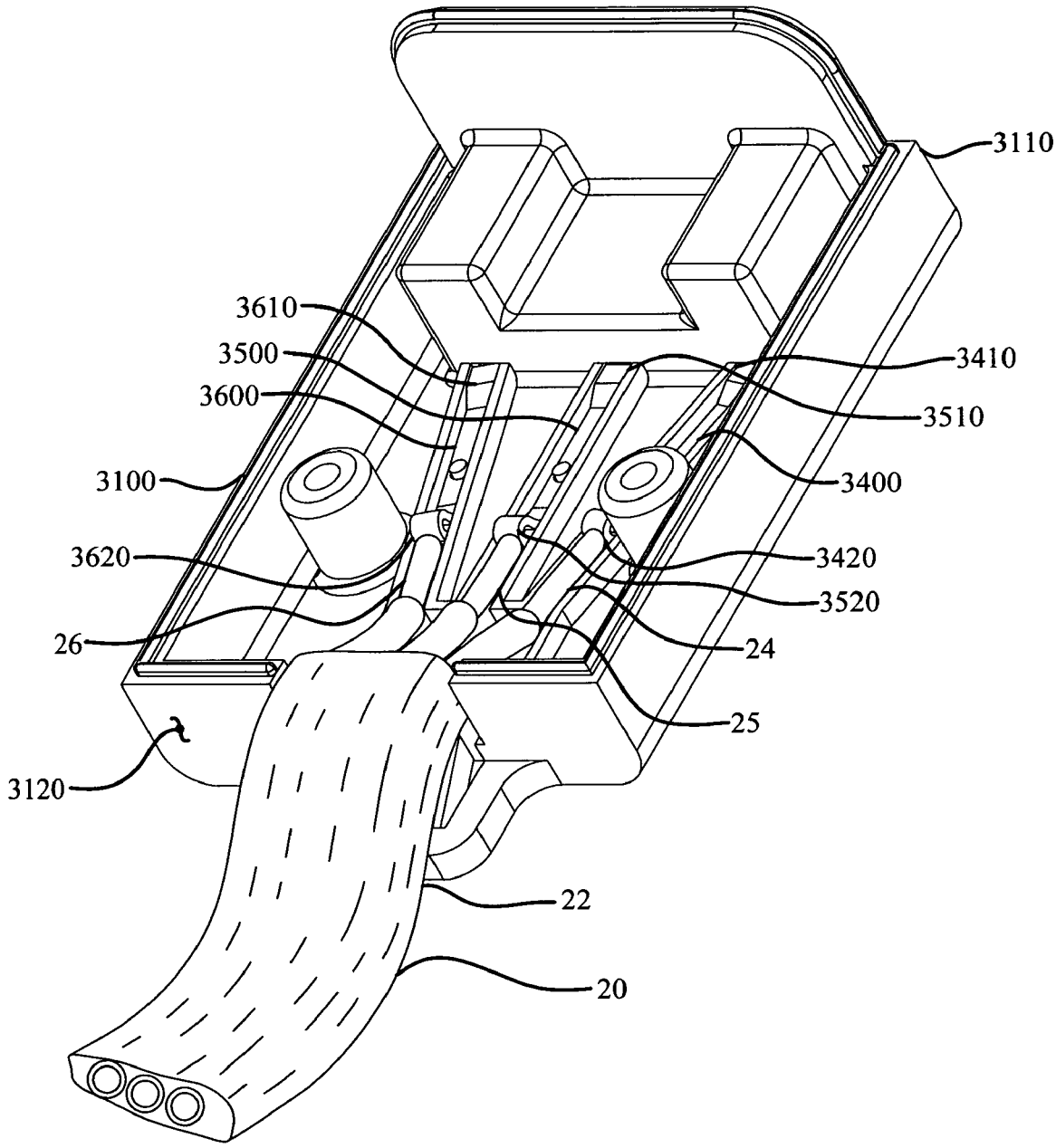
FIG. 11 is an isometric view of an embodiment of the distribution connector base, showing connection of the power supply cable, not to scale.
Figure 12:
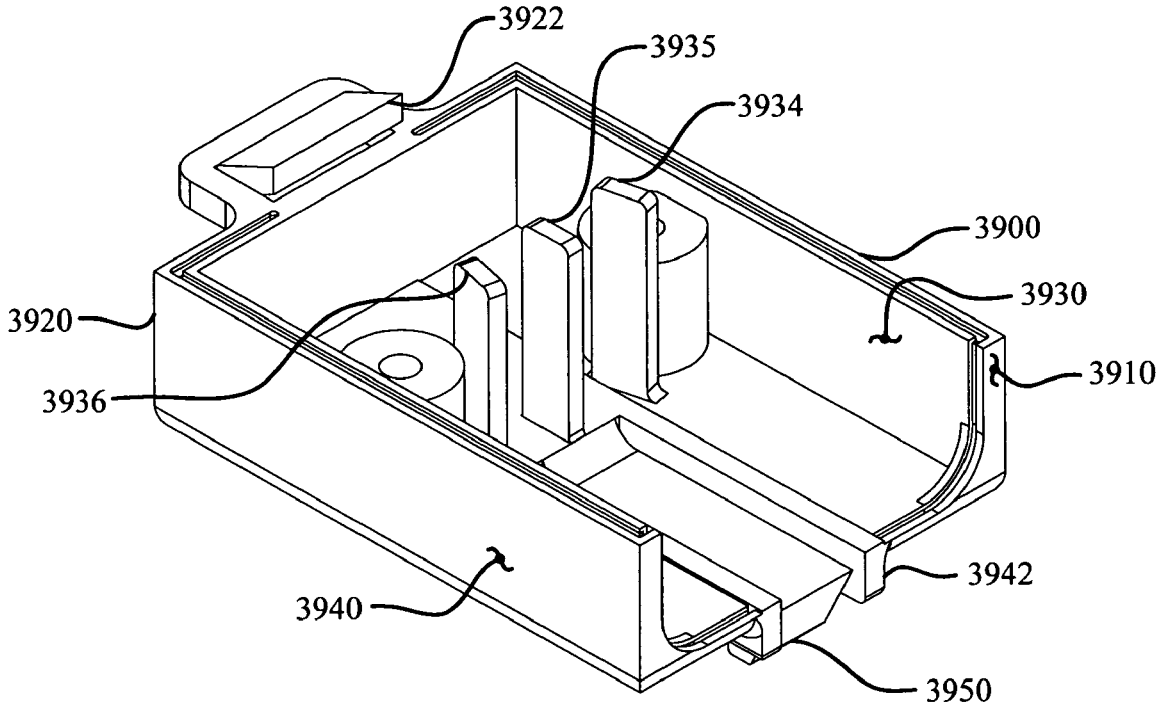
FIG. 12 is an isometric view of an embodiment of the distribution connector clamp, not to scale.
Figure 13:
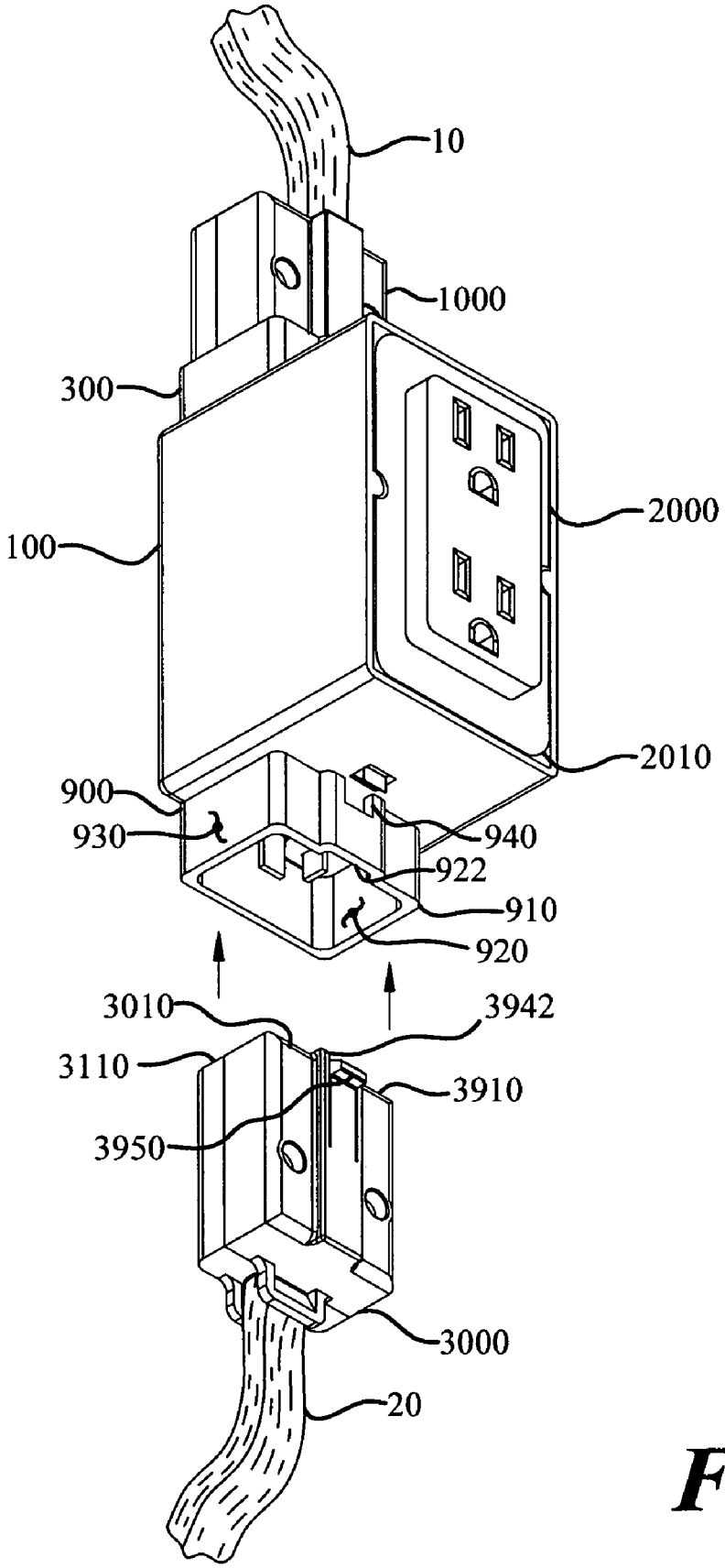
FIG. 13 is an isometric view of an embodiment of the electrical connection system showing the distribution connection, not to scale.

As seen in FIG. 13, in this embodiment, a power distribution cable (20) is inserted into a distribution connector housing (3000) which, in turn, connects to the junction box (100) for distributing electrical power to one or more additional junction boxes (100). The power distribution cable (20) contains additional electrical conductors for distributing electricity. By way of example only, and not limitation, as seen in FIG. 11, the power distribution cable (20) may contain a distribution line conductor (24), a distribution ground conductor (25), and a distribution neutral conductor (26), collectively referred to as the "three distribution conductors." The power distribution cable (20) may also have a distribution insulating sheath (22) for protecting the three distribution conductors. The distribution connector housing (3000) may have a distribution connector base (3100) and a distribution connector clamp (3900), as seen in FIG. 13. While FIGS. 10, 11, and 12 illustrate the distribution connector housing (3000) as split longitudinally such that the proximal ends (3110, 3910) form the perimeter (3010), as one skilled in the art will observe and appreciate, the distribution connector housing (3000) may be formed from a clamp and a base split laterally, or, in another embodiment, the distribution connector housing (3000) may be a unitary housing with a clamp formed around an interior base. In other alternative embodiments of the distribution connector housing (3000), the distribution base proximal end (3010) may simply be the end profile of either the distribution connector base (3100) or the distribution connector clamp (3900), not both together.

Referring now to FIGS. 10, 11, and 12, the distribution connector base (3100) may have a distribution base proximal end (3110) and a distribution base distal end (3120). As seen in FIG. 10, the distribution base proximal end (3110) may be formed with a distribution line bus prong receiver (3114), a distribution ground bus prong receiver (3115), and a distribution neutral bus prong receiver (3116). The distribution base distal end (3120) may be formed with a distribution cable insertion channel (3124) and a distribution base sheath retainer (3122). The distribution connector base (3100), as seen in FIG. 11, houses a distribution line connector (3400), a distribution ground connector (3500), and a distribution neutral connector (3600), similar to the configuration of the supply connector housing (1000).

With continued reference to FIG. 11, the distribution line connector (3400) has a distribution line bus contact end (3410) and a distribution line conductor contact end (3420), the distribution ground connector (3500) has a distribution ground bus contact end (3510) and a distribution ground conductor contact end (3520), and the distribution neutral connector (3600) has a distribution neutral bus contact end (3610) and a distribution neutral conductor contact end (3620). The distribution line bus contact end (3410) substantially aligns with the distribution line bus prong receiver (3114), the distribution ground contact end (3510) substantially aligns with the distribution ground bus prong receiver (3115), and the distribution neutral bus contact end (3610) substantially aligns with the distribution neutral bus prong receiver (3116). The distribution line conductor contact end (3420), the distribution ground conductor contact end (3520), and the distribution neutral conductor contact end (3620) are substantially aligned with the distribution cable insertion channel (3124).

When the power distribution cable (20) is inserted into the distribution cable insertion channel (3124), the distribution line conductor (24) is brought into electrical communication with the distribution line conductor contact end (3420), the ground conductor (25) is brought into electrical communication with the distribution ground conductor contact end (3520), and the distribution neutral conductor (26) is brought into electrical communication with the distribution neutral conductor contact end (3620). Following insertion of the power distribution cable (20) into the distribution connector base (3100), the distribution connector clamp (3900) is releasably connected to the distribution connector base (3100).

As seen in FIG. 12, the distribution connector clamp (3900) may include a distribution clamp proximal end (3910) and a distribution clamp distal end (3920). The distribution connector clamp (3900) is fastened to the distribution connector base (3100), as seen in FIG. 13, such that the distribution line conductor (24), the distribution ground conductor (25), and the distribution neutral conductor (26) are substantially prevented from withdrawing from the distribution connector housing (3000). In one embodiment of the instant invention, seen in FIG. 12, the distribution connector clamp (3900) has an interior surface (3930) with a distribution line clamp (3934), a distribution ground clamp (3935), and a distribution neutral clamp (3936). The clamps (3934, 3935, 3936) releasably engage the distribution line connector (3400), the distribution ground connector (3500), and the distribution neutral connector (3600) thereby substantially preventing the distribution line conductor (24), the distribution ground conductor (25), and the distribution neutral conductor (26) from being unintentionally withdrawn from the distribution connector housing (3000). In another embodiment of the distribution connector clamp (3900), also seen in FIG. 12, the distribution connector clamp (3900) has a distribution sheath retainer (3922) that releasably grips the distribution insulating sheath (22) and may assist in substantially preventing the unintentional withdrawal of the power distribution cable (20) from the distribution connector clamp (3900).

With reference to the embodiment of FIG. 13, following assembly of the distribution connector housing (3000), the distribution base proximal end (3110) and the distribution clamp proximal end (3910) form a distribution connector housing perimeter (3010). The distribution base proximal end (3110) and the distribution clamp proximal end (3910) are brought into position substantially against the sidewall (200). The line bus distribution prong (430) enters the distribution line bus prong receiver (3114) so that the line bus distribution prong (430) is in electrical communication with the distribution line bus prong contact end (3410), the ground bus distribution prong (530) enters the distribution ground bus prong receiver (3115) so that the ground bus distribution prong (530) is in electrical communication with the distribution ground bus contact end (3510), and the neutral bus distribution prong (630) enters the neutral bus prong receiver (3116) so that the neutral bus distribution prong (630) is in electrical communication with the distribution neutral bus contact end (3610).

As one skilled in the art will observe and appreciate, once the distribution connector housing (3000) is properly positioned, electrical continuity exists from the line conductor (14), to the line bus (400), and to the distribution line conductor (24). Similarly, electrical continuity exists from the ground conductor (15), to the ground bus (500), and to the distribution ground conductor (25), and the electrical continuity exists from the neutral conductor (16), to the neutral bus (600), and to the distribution neutral conductor (26).

In another embodiment of the instant invention, as seen in FIGS. 9 and 13, the junction box (100) further includes a distribution connector shroud (900). Similar to the supply connector shroud (300), the distribution connector shroud (900) has a distribution connector rim (910) having a distribution connector interior surface (920) and a distribution connector exterior surface (930). The distribution connector interior surface (920) may be formed with a distribution connector alignment recess (922). The distribution connector shroud (900) may also be formed with a distribution connector retaining prong catch (940). In addition, the distribution connector clamp (3900) has a distribution clamp exterior surface (3940), and may be formed with a distribution connector retaining prong (3950). The distribution clamp exterior surface (3940) may also be formed with a distribution alignment fixture (3942), which cooperates with the distribution connector alignment recess (922), substantially preventing the distribution connector housing (3000) from being inserted into the distribution connector shroud (900) an inappropriate orientation. When the distribution connector housing (3000) is inserted into the distribution connector shroud (900), as seen in FIG. 13, the distribution connector retaining prong (3950) releasably engages the distribution connector retaining prong catch (940) substantially preventing the unintentional withdrawal of the distribution connector housing (3000) from the distribution connector shroud (900).

As one skilled in the art will observe and appreciate, although the figures illustrate a system with one distribution connector housing (3000), multiple connector housings (3000) may be connected by protruding additional distribution prongs (430, 530, 630) through the sidewall (200) by forming buses (400, 500, 600) of different shapes within the junction box (100).

In another embodiment of the present invention, as seen in FIG. 1, the sidewall (200) is formed with a receptacle retaining prong catch (280) and the receptacle (2000) has a receptacle retaining prong (2040). When the receptacle (2000) is inserted into the junction box (100), the receptacle retaining prong (2040) releasably engages the receptacle retaining prong catch (280) substantially preventing the receptacle (2000) from being unintentionally withdrawn from the junction box (100).

In yet another embodiment of the instant invention, as seen in FIG. 1, the sidewall (200) has a perimeter (210), and the sidewall interior surface (260) is formed with a receptacle alignment fixture (262). The receptacle (2000) has a receptacle perimeter (2010), and the receptacle (2000) is formed with an alignment recess (2050). The receptacle (2000) is inserted into the junction box (100) such that the receptacle alignment fixture (262) cooperates with the alignment recess (2050). The receptacle alignment fixture (262) helps guide the line blade (2034), the ground blade (2035), and the neutral blade (2036) into electrical communication with the line bus (400), the ground bus (500), and the neutral bus (600), respectively. As one skilled in the art will observe and appreciate, the receptacle alignment fixture (262) may be a recess that cooperates with the receptacle (2000) where the alignment recess (2050) is a projection. Simply put, the fixture (262) and the recess (2050) cooperate to guide the receptacle (2000) into the junction box (100).

In another embodiment of the instant invention, as seen in FIG. 9, the sidewall (200) is formed with a proximal side (220), a distal side (230), a dextral side (240), and a sinistral side (250). In another embodiment of the present invention, the perimeter (210) and the receptacle perimeter (2010) are substantially the same. As one skilled in the art will appreciate, when the perimeter (210) and the receptacle perimeter (2010) are substantially the same, the space between the perimeter (210) and the receptacle perimeter (2010) is such that foreign objects such as fingers and tools may not gain easy access. In still another embodiment of the instant invention, the receptacle (2000) overlaps or caps the junction box (100) so that the two butting surfaces are parallel with a wall, ceiling, or floor surface.

Figure 14:
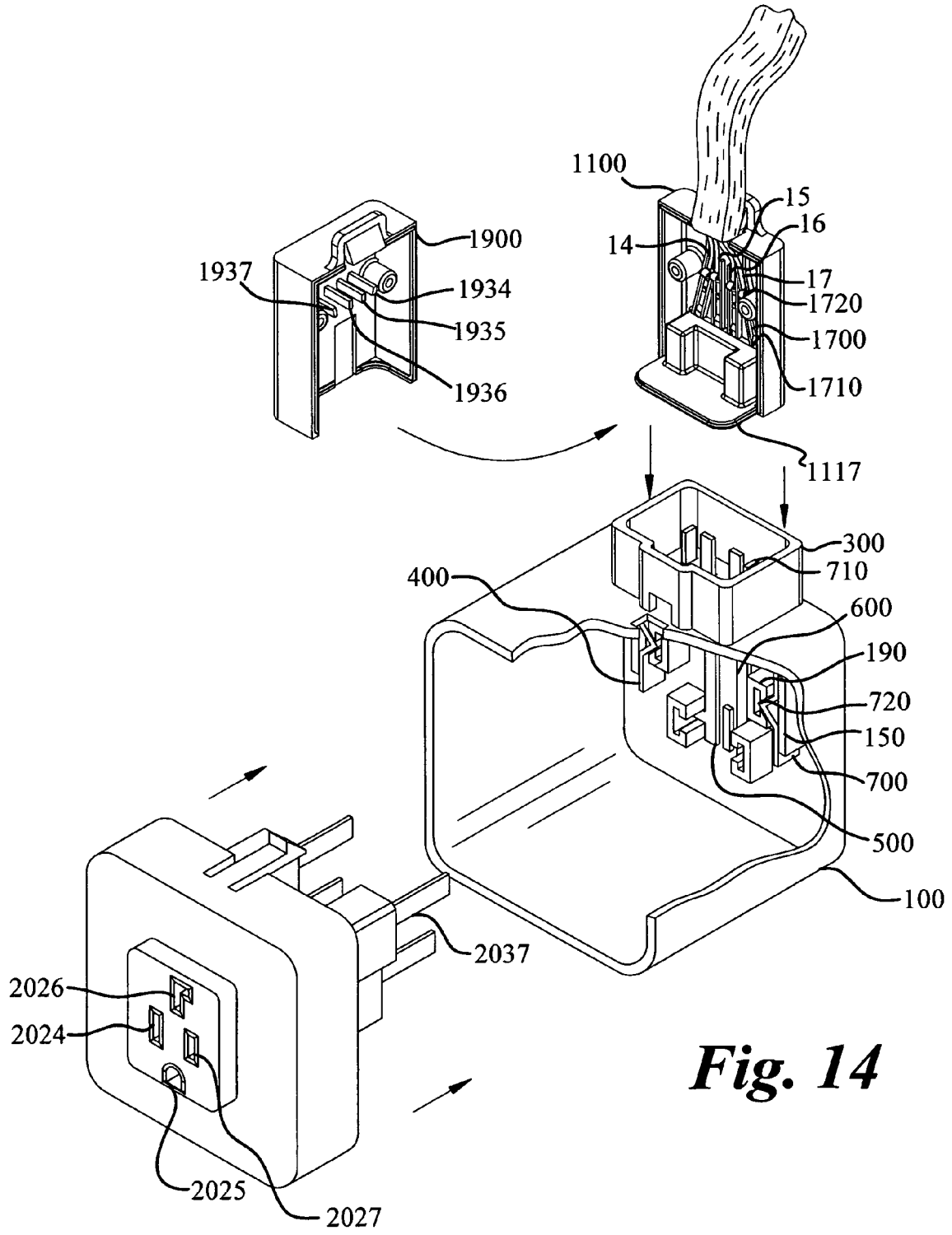
FIG. 14 is an isometric view of an embodiment of the electrical connection system showing supply of four conductors, not to scale.

In still another embodiment, as seen in FIG. 14, the junction box (100) may include a second line bus (700) bringing the total number of buses to four. As one skilled in the art will observe and appreciate, the availability of an additional bus builds more flexibility into the system (50). The second line bus (700) has a second line bus supply prong (710) and a second line bus blade connector (720). The second line bus (700) penetrates the junction box sidewall (200) passing through the sidewall interior surface (260) and through the sidewall exterior surface (270) such that the second line bus supply prong (710) protrudes from the sidewall exterior surface (270).

To provide electrical connectivity to the second line bus (700), the supply connector base (1100) may further include a supply second line connector (1700) having a supply second line bus contact end (1710) and a supply second line conductor contact end (1720), as seen in FIG. 14. Consequently, the supply base proximal end (1110) is formed with a supply second line bus prong receiver (1117). The supply second line bus contact end (1710) substantially aligns with the supply second line bus prong receiver (1117) and the supply second line conductor contact end (1720) is substantially aligned with the supply cable insertion channel (1124).

When the power supply cable (10) housing a second line conductor (17), which is an additional, or fourth, conductor, is inserted into the supply cable insertion channel (1124), the second line conductor (17) is brought into electrical communication with the supply second line conductor contact end (1720). Once the three conductors and the second line conductor (17) are in position, the supply connector clamp (1900) is fastened to the supply connector base (1100). In an embodiment of the instant invention, as described above, with the supply connector clamp (1900) having the clamps (1934, 1935, 1936), the supply connector clamp (1900) may also be formed with a supply second line clamp (1937) that substantially prevents the second line conductor (17) from being withdrawn from the supply connector housing (1000). Once assembled, the supply connector housing (1000) may be properly positioned on the junction box (100).

When the supply connector housing (1000), which houses the second line conductor (17) in addition to the three conductors, as seen in FIG. 14, is properly positioned on the junction box (100), the second line bus supply prong (710) enters the supply line bus prong receiver (1117) so that the second line bus supply prong (710) is in electrical communication with the supply second line bus prong contact end (1710). Similarly, the other bus prongs (410, 510, 610) also enter their respective supply bus prong receivers (1114, 1115, 1116) and are in electrical communication with their respective contact ends (1410, 1510, 1610). As one skilled in the art will observe and appreciate, and by way of example and not limitation, in the situation where it becomes desirable to install a 240V AC circuit in a residence, two 120V line phases can be supplied and electrically connected to the buses (400, 700) within junction box (100). In another example, in an industrial setting, three phase power from a wye or delta configuration, may be routed to various receptacles for use.

In another embodiment of the instant invention, as seen in FIG. 14, the receptacle (2000) may further include a second line prong receiver (2027) for cooperation with a second line prong (not shown). Consequently, the receptacle (2000) may also have a second line blade (2037). When the second line bus (700) is present and the receptacle (2000) is inserted into the junction box (100), the second line blade (2037) releasably engages, and is in electrical communication with, the second line bus blade connector (720) such that electrically continuity exists between the second line conductor (17) and the second line prong receiver (2027). As previously mentioned and by way of example and not limitation, the receptacle (2000) may be a NEMA 14-30 or 14-50 receptacle for providing 240V AC electrical connectivity to an electric range or a clothes dryer. However, even if the power supply cable (10) provides, for example, 240V AC from two 120V lines, the receptacle (2000) may only have three blades. In other words, it is not necessary to have each receptacle (2000) connect to the second line bus (700). More specifically, the line blade (2034), the ground blade (2035), and the neutral blade (2036) may provide 120V AC electrical connectivity from a junction box (100) having 240V AC connectivity. The 240V AC electrical connectivity may be distributed to other junction boxes (100) as described below.

Figure 15:
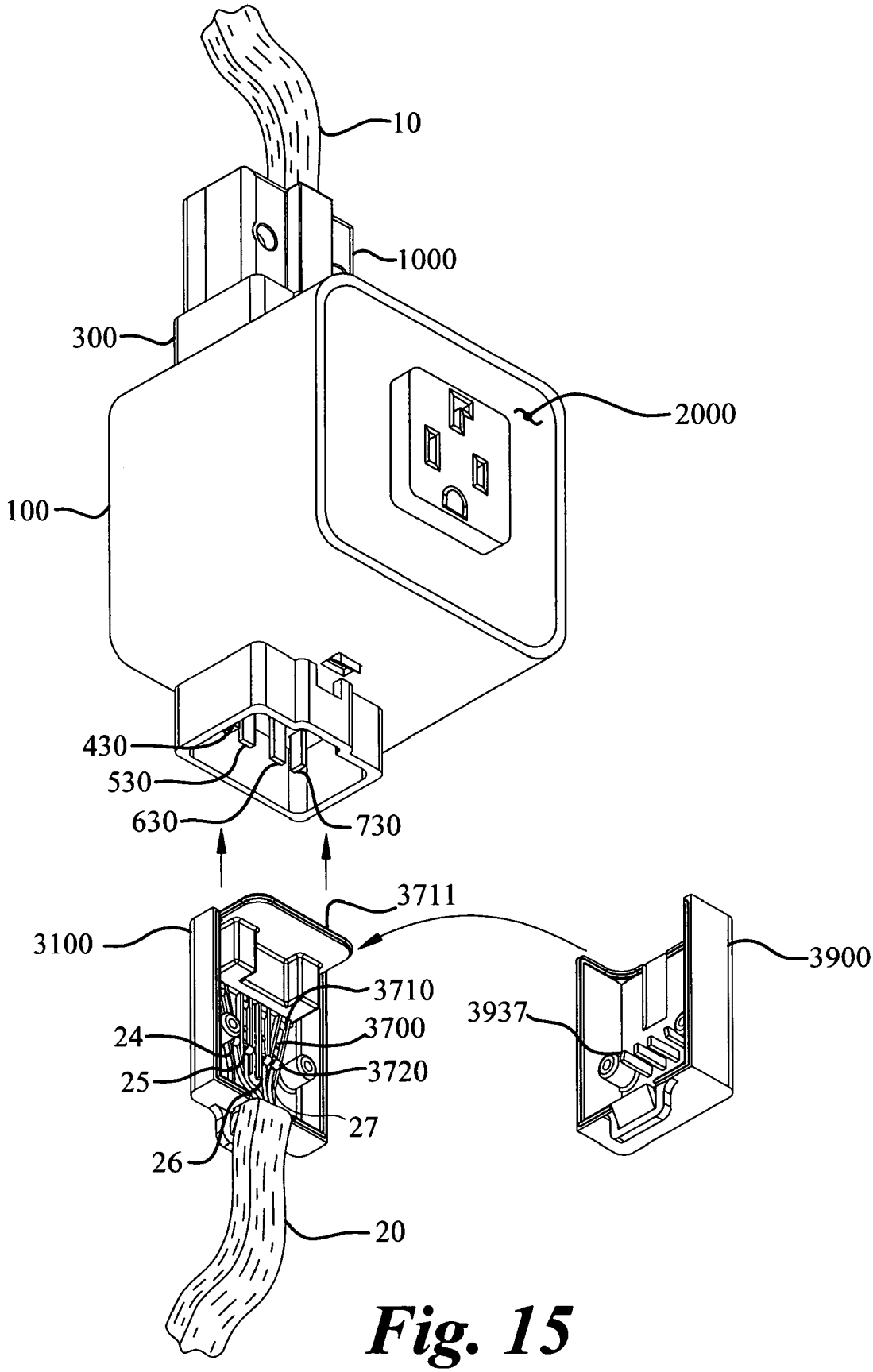
FIG. 15 is an isometric view of an embodiment of the electrical connection system showing distribution of four conductors, not to scale.

In another embodiment of the instant invention, as seen in FIG. 15, the second line bus (700) is formed with a second line bus distribution prong (730). The distribution connector housing (3000) may include a distribution second line bus prong receiver (3117), and the distribution base distal end (3120) may house a distribution second line connector (3700). The distribution second line connector (3700) has a distribution second line bus contact end (3710) and a distribution second line conductor contact end (3720). The distribution second line bus contact end (3710) substantially aligns with the distribution second line bus prong receiver (3117). The distribution second line conductor contact end (3720) is substantially aligned with the distribution cable insertion channel (3124). The power distribution cable (20) may have a distribution second line conductor (27), which is a fourth conductor. When the power distribution cable (20) is inserted into the distribution cable insertion channel (3124), the three distribution conductors are inserted into their respective contact ends (3420, 3520, 3620), as previously explained, and the distribution second line conductor (27) is inserted into electrical communication with the distribution second line conductor contact end (3720). Once the three distribution conductors, plus the distribution second line conductor (27) are inserted into the distribution connector base (3100), the distribution connector clamp (3900) is fastened to the distribution connector base (3100) substantially preventing the unintentional withdrawal of the three distribution conductors and the distribution second line conductor (27). By way of example, and not limitation, in a residence, the power distribution cable (20) may be ROMEX NM-B 10-3 sheathed cable for connecting an electric range or clothes dryer.

In one embodiment of the instant invention having the distribution clamps (3934, 3935, 3936) and having the distribution second line conductor (27), the distribution connector clamp (3900) may have a distribution second line clamp (3937). The distribution second line clamp (3937) releasably contacts the distribution second line connector (3700) forcibly holding the second line conductor (27) thereby substantially preventing the second line conductor (27) from being unintentionally withdrawn from the distribution connector housing (3000).

Following assembly of the distribution connector housing (3000), the distribution base proximal end (3110) and the distribution clamp proximal end (3910) are brought into position substantially against the sidewall (200). As previously described, the line bus distribution prong (430) enters the distribution line bus prong receiver (3114) so that the line bus distribution prong (430) is in electrical communication with the distribution line bus prong contact end (3410), the ground bus distribution prong (530) enters the distribution ground bus prong receiver (3115) so that the ground bus distribution prong (530) is in electrical communication with the distribution ground bus contact end (3510), the neutral bus distribution prong (630) enters the neutral bus prong receiver (3116) so that the neutral bus distribution prong (630) is in electrical communication with the distribution neutral bus contact end (3610), and the second line bus distribution prong (730) protrudes through the sidewall (200) and enters the second line bus prong receiver (3117) so that the second line bus distribution prong (730) is in electrical communication with the distribution second line bus contact end (3710). As one skilled in the art will observe and appreciate, it is then possible to distribute four conductors to multiple junction boxes (100) and insert the receptacles (2000) having three or four blades into the junction box (100) to provide the desired electrical connectivity.

In another embodiment, seen in FIG. 14, the bus support surface (110) is formed with a second line bus blade alignment fixture (190). So, when the receptacle (2000) is inserted into the junction box (100), the three blades (2034, 2035, 2036) releasably engage the blade alignment fixtures (160, 170, 180), and the second line blade (2037) releasably engages the second line bus blade alignment fixture (190) and the second line blade (2037) is held in electrical communication with the second line bus blade connector (720) by the second line bus blade alignment fixture (190).

In another embodiment, seen in FIG. 14, the bus support surface (110) is formed with a second line bus support (150). Like the other bus supports (120, 130, 140), the second line bus support (150) is positioned to support the second line bus blade connector (720). The second line bus support (150) may enhance the mechanical strength of the second line bus (700) and substantially prevent the second line bus (700) from flexing, or otherwise moving, out of position when the second line blade (2037) is forced into contact with the second line bus connector (720).

Figure 16:
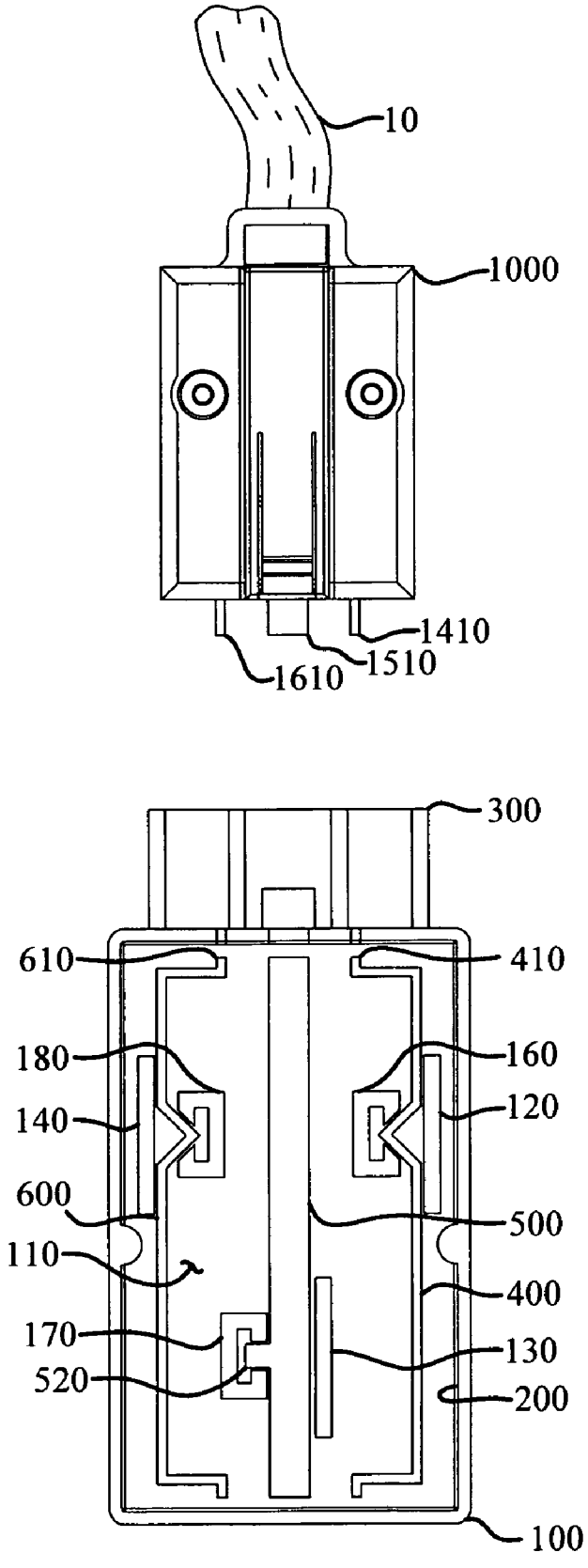
FIG. 16 is an isometric view of an embodiment of the electrical connection system, not to scale.

As one skilled in the art will observe and appreciate, while the line bus (400), the ground bus (500), the neutral bus (600), and where applicable, the second line bus (700) have been described as having a portion of the bus protruding through the sidewall (200), in another embodiment of the instant invention, the buses (400, 500, 600, 700) may remain within the junction box (100). As seen in FIG. 16, in this embodiment then, the supply connector housing (1000) and any distribution connector housings (3000) have connectors (1400, 1500, 1600, 1700) that extend beyond the supply connector housing (1000) or distribution connector housing (3000). The extension of the connectors (1400, 1500, 1600, 1700) allow the connectors (1400, 1500, 1600, 1700) to be inserted through the sidewall (200) and electrically connect to their respective buses (400, 500, 600, 700) as described above.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. An electrical connection system (50) for electrically connecting a power supply cable (10) to an electrical load (30) where the power supply cable (10) has an insulating sheath (12) enclosing a line conductor (14), a ground conductor (15), a neutral conductor (16), and a second line conductor (17), comprising:

(I) a junction box (100) formed with a bus support surface (110) and at least one sidewall (200) having an interior surface (260) and an exterior surface (270), the junction box (100) houses a line bus (400), a ground bus (500), and a neutral bus (600), wherein, (A) the line bus (400) is formed with a line bus supply prong (410) and a line bus blade connector (420), (B) the ground bus (500) is formed with a ground bus supply prong (510) and a ground bus blade connector (520), and (C) the neutral bus (600) is formed with a neutral bus supply prong (610) and a neutral bus blade connector (620); and (D) the line bus (400), the ground bus (500) and the neutral bus (600) penetrate the junction box sidewall (200) passing through the sidewall interior surface (260) and through the sidewall exterior surface (270) such that the line bus supply prong (410), the ground bus supply prong (510), and the neutral bus supply prong (610) protrude from the sidewall exterior surface (270);

(II) a supply connector housing (1000) having a supply connector base (1100) and a supply connector clamp (1900), wherein, (A) the supply connector base (1100) has a supply base proximal end (1110) and a supply base distal end (1120), wherein the supply base proximal end (1110) is formed with a supply line bus prong receiver (1114), a supply ground bus prong receiver (1115), and a supply neutral bus prong receiver (1116), and the supply base distal end (1120) is formed with a supply cable insertion channel (1124), and the supply connector base (1100) houses a supply line connector (1400), a supply ground connector (1500), and a supply neutral connector (1600), wherein, (i) the supply line connector (1400) has a supply line bus contact end (1410) and a supply line conductor contact end (1420), (ii) the supply ground connector (1500) has a supply ground bus contact end (1510) and a supply ground conductor contact end (1520), (iii) the supply neutral connector (1600) has a supply neutral bus contact end (1610) and a supply neutral conductor contact end (1620), and (iv) when the power supply cable (10) is inserted into the supply cable insertion channel (1124), the line conductor (14) is brought into electrical communication with the supply line conductor contact end (1420), the ground conductor (15) is brought into electrical communication with the supply ground conductor contact end (1520), and the supply neutral conductor (16) is brought into electrical communication with the neutral conductor contact end (1620); and (B) the supply connector clamp (1900) has a supply clamp proximal end (1910) and a supply clamp distal end (1920), wherein the supply connector clamp (1900) releasably cooperates with the supply connector base (1100) such that the line conductor (14), the ground conductor (15), and the neutral conductor (16) are substantially prevented from unintentionally withdrawing from the supply connector housing (1000), and when the supply base proximal end (1110) and the supply clamp proximal end (1910) are brought into position substantially against the sidewall (200), (i) the line bus supply prong (410) enters the supply line bus prong receiver (1114) so that the line bus supply prong (410) is in electrical communication with the supply line bus prong contact end (1410), (ii) the ground bus supply prong (510) enters the supply ground bus prong receiver (1115) so that the ground bus supply prong (510) is in electrical communication with the supply ground bus contact end (1510), and (iii) the neutral bus supply prong (610) enters the neutral bus prong receiver (1116) so that the neutral bus supply prong (610) is in electrical communication with the supply neutral bus contact end (1610); and (III) a receptacle (2000) formed with a receptacle face (2020) and a receptacle back (2030), wherein the receptacle face (2020) is formed with a line prong receiver (2024), a ground prong receiver (2025), and a neutral prong receiver (2026), and the receptacle (2000) has a line blade (2034), a ground blade (2035), and a neutral blade (2036) that extend from the receptacle back (2030), wherein, (A) the line prong receiver (2024) is in electrical communication with the line blade (2034), the ground prong receiver (2025) is in electrical communication with the ground blade (2035), and the neutral prong receiver (2026) is in electrical communication with the neutral blade (2036); and (B) when the receptacle (2000) is inserted into the junction box (100), the line blade (2034) releasably engages, and is in electrical communication with, the line bus blade connector (420); the ground blade (2035) releasably engages, and is in electrical communication with, the ground bus blade connector (520); and the neutral blade (2036) releasably engages, and is in electrical communication with, the neutral bus blade connector (620), and whereby electrical continuity exists from the line prong receiver (2024) to the line conductor (14), from the ground prong receiver (2025) to the ground conductor (15), and from the neutral prong receiver (2026) to the neutral conductor (16).

2. The electrical connection system (50) of claim 1, wherein the junction box (100) further includes a supply connector shroud (300) having a supply connector rim (310), wherein, (A) the supply connector shroud (300) is formed with a supply connector retaining prong catch (340), and (B) the supply connector housing (1000) is formed with a supply connector retaining prong (1950); such that, (C) when the supply connector housing (1000) is positioned within the supply connector rim (310), the supply connector retaining prong (1950) releasably engages the supply connector retaining prong catch (340) substantially preventing the unintentional withdrawal of the supply connector housing (1000) from the supply connector shroud (300).

3. The electrical connection system (50) of claim 1, wherein the bus support surface (110) is formed with a line bus blade alignment fixture (160), a ground bus blade alignment fixture (170), and a neutral bus blade alignment fixture (180), wherein when the receptacle (2000) is inserted into the junction box (100), (A) the line blade (2034) releasably engages the line bus blade alignment fixture (160) and the line blade (2034) is held in electrical communication with the line bus blade connector (420) by the line bus blade alignment fixture (160), (B) the ground blade (2035) releasably engages the ground blade alignment fixture (170) and the ground blade (2035) is held in electrical communication with the ground bus blade connector (520) by the ground blade alignment fixture (170), and (C) the neutral blade (2036) releasably engages the neutral blade alignment fixture (180) and the neutral blade (2036) is held in electrical communication with the neutral bus blade connector (620) by the neutral blade alignment fixture (180).

4. The electrical connection system (50) of claim 1, wherein the sidewall (200) is formed with a receptacle retaining prong catch (280) and the receptacle (2000) has a receptacle retaining prong (2040), wherein when the receptacle (2000) is inserted into the junction box (100), the receptacle retaining prong (2040) releasably engages the receptacle retaining prong catch (280) substantially preventing the receptacle (2000) from being unintentionally withdrawn from the junction box (100).

5. The electrical connection system (50) of claim 1, further including a distribution connector housing (3000) having a distribution connector base (3100) and a distribution connector clamp (3900), wherein, (A) the distribution connector base (3100) has a distribution base proximal end (3110) and a distribution base distal end (3120), wherein the distribution base proximal end (3110) is formed with a distribution line bus prong receiver (3114), a distribution ground bus prong receiver (3115), and a distribution neutral bus prong receiver (3116), and the distribution base distal end (3120) is formed with a distribution cable insertion channel (3124), and the distribution connector base (3100) houses a distribution line connector (3400), a distribution ground connector (3500), and a distribution neutral connector (3600), wherein, (i) the distribution line connector (3400) has a distribution line bus contact end (3410) and a distribution line conductor contact end (3420), (ii) the distribution ground connector (3500) has a distribution ground bus contact end (3510) and a distribution ground conductor contact end (3520), and (iii) the distribution neutral connector (3600) has a distribution neutral bus contact end (3610) and a distribution neutral conductor contact end (3620), and (iv) when a power distribution cable (20) having a distribution line conductor (24), a distribution ground conductor (25), and a distribution neutral conductor (26) is brought into the distribution cable insertion channel (3124), the distribution line conductor (24) is brought into electrical communication with the distribution line conductor contact end (3420), the ground conductor (25) is brought into electrical communication with the distribution ground conductor contact end (3520), and the distribution neutral conductor (26) is inserted into electrical communication with the distribution neutral conductor contact end (3620); and (B) the distribution connector clamp (3900) has a distribution clamp proximal end (3910) and a distribution clamp distal end (3920) wherein the distribution connector clamp (3900) is fastened to the distribution connector base (3100) such that the distribution line conductor (24), the distribution ground conductor (25), and the distribution neutral conductor (26) are substantially prevented from unintentionally withdrawing from the distribution connector housing (3000); and (C) the line bus (400) is formed with a line bus distribution prong (430), the ground bus (500) is formed with a ground bus distribution prong (530), and the neutral bus (600) is formed with a neutral bus distribution prong (630), wherein the line bus (400), the ground bus (500) and the neutral bus (600) penetrate the junction box sidewall (200) passing through the sidewall interior surface (260) and through the sidewall exterior surface (270) such that the line bus distribution prong (430), the ground bus distribution prong (530), and the neutral bus distribution prong (630) protrude from the sidewall exterior surface (270), when the distribution base proximal end (3110) and the distribution clamp proximal end (3910) are brought into position substantially against the sidewall (200), (i) the line bus distribution prong (410) enters the distribution line bus prong receiver (3114) so that the line bus distribution prong (410) is in electrical communication with the distribution line bus prong contact end (3410), (ii) the ground bus distribution prong (510) enters the distribution ground bus prong receiver (3115) so that the ground bus distribution prong (510) is in electrical communication with the distribution ground bus contact end (3510), and (iii) the neutral bus distribution prong (610) enters the neutral bus prong receiver (3116) so that the neutral bus distribution prong (610) is in electrical communication with the distribution neutral bus contact end (3610).

6. The electrical connection system (50) of claim 5, wherein the junction box (100) further includes a distribution connector shroud (900) having a distribution connector rim (910) and the distribution connector shroud (900) is formed with a distribution connector retaining prong catch (940), wherein the distribution connector housing (3000) is formed with a distribution connector retaining prong (3950), and when the distribution connector housing (3000) is inserted into the distribution connector shroud (900), the distribution connector retaining prong (3950) releasably engages the distribution connector retaining prong catch (940) substantially preventing the unintentional withdrawal of the distribution connector housing (3000) from the distribution connector shroud (900).

7. The electrical connection system (50) of claim 1, wherein the sidewall (200) has a perimeter (210), the sidewall (200) is formed with a receptacle alignment fixture (262), the receptacle (2000) has a receptacle perimeter (2010), and the receptacle (2000) is formed with an alignment recess (2050), and when the receptacle (2000) is inserted into the junction box (100), the receptacle alignment fixture (262) cooperates with the alignment recess (2050) substantially guiding the line blade (2034), the ground blade (2035), and the neutral blade (2036) into position.

8. The electrical connection system (50) of claim 7, wherein the sidewall (200) is formed with a proximal side (220), a distal side (230), a dextral side (240), and a sinistral side (250), wherein the perimeter (210) and the receptacle perimeter (2010) are substantially the same.

9. The electrical connection system (50) of claim 1, wherein the junction box (100) further includes a second line bus (700) having a second line bus supply prong (710) and a second line bus blade connector (720), the supply connector base (1100) further includes a supply second line connector (1700) having a supply second line bus contact end (1710) and a supply second line conductor contact end (1720), and the supply base proximal end (1110) is formed with a supply second line bus prong receiver (1117), wherein (A) the second line bus (700) penetrates the junction box sidewall (200) passing through the sidewall interior surface (260) and through the sidewall exterior surface (270) such that the second line bus supply prong (710) protrudes from the sidewall exterior surface (270), and (B) when the power supply cable (10) is inserted into the supply cable insertion channel (1124), the second line conductor (17) is brought into electrical communication with the supply second line conductor contact end (1720), and the supply second line conductor (17) is substantially prevented from unintentionally withdrawing from the supply connector housing (1000), and (C) when the supply connector housing (1000) is the second line bus supply prong (710) enters the supply line bus prong receiver (1117) so that the second line bus supply prong (710) is in electrical communication with the supply second line bus prong contact end (1710).

10. The electrical connection system (50) of claim 9, wherein the receptacle (2000) further includes a second line prong receiver (2027) and a second line blade (2037), wherein when the receptacle (2000) is inserted into the junction box (100), the second line blade (2037) releasably engages, and is in electrical communication with, the second line bus blade connector (720) such that electrically continuity substantially exists between the second line conductor (17) and the second line prong receiver (2027).

11. The electrical connection system (50) of claim 9, further including a distribution connector housing (3000) having a distribution connector base (3100) and a distribution connector clamp (3900), wherein, (A) the distribution connector base (3100) has a distribution base proximal end (3110) and a distribution base distal end (3120), wherein the distribution base proximal end (3110) is formed with a distribution line bus prong receiver (3114), a distribution ground bus prong receiver (3115), a distribution neutral bus prong receiver (3116), and a distribution second line bus prong receiver (3117), and the distribution base distal end (3120) is formed with a distribution cable insertion channel (3124), and the distribution connector base (3100) houses a distribution line connector (3400), a distribution ground connector (3500), a distribution neutral connector (3600), and a distribution second line connector (3700), wherein, (i) the distribution line connector (3400) has a distribution line bus contact end (3410) and a distribution line conductor contact end (3420), (ii) the distribution ground connector (3500) has a distribution ground bus contact end (3510) and a distribution ground conductor contact end (3520), (iii) the distribution neutral connector (3600) has a distribution neutral bus contact end (3610) and a distribution neutral conductor contact end (3620), and (iv) the distribution second line connector (3700) has a distribution second line bus contact end (3710) and a distribution second line conductor contact end (3720); and (v) when the power distribution cable (20) is inserted into the distribution cable insertion channel (3124), the distribution line conductor (24) is brought into electrical communication with the distribution line conductor contact end (3420), the ground conductor (25) is brought into electrical communication with the distribution ground conductor contact end (3520), the distribution neutral conductor (26) is brought into electrical communication with the distribution neutral conductor contact end (3620), and the distribution second line conductor (27) is brought into electrical communication with the distribution second line conductor contact end (3720); and (B) the distribution connector clamp (3900) has a distribution clamp proximal end (3910) and a distribution clamp distal end (3920), wherein the distribution connector clamp (3900) is fastened to the distribution connector base (3100) such that the distribution line conductor (24), the distribution ground conductor (25), the distribution neutral conductor (26), and the distribution second line conductor (27) are substantially prevented from unintentional withdrawal from the distribution connector housing (3000), and (C) the line bus (400) has a line bus distribution prong (430), the ground bus (500) has a ground bus distribution prong (530), the neutral bus (600) has a neutral bus distribution prong (630), and the second line bus (700) has a second line bus distribution prong (730), wherein the line bus (400), the ground bus (500), the neutral bus (600), and the second line bus (700) penetrate the junction box sidewall (200) passing through the sidewall interior surface (260) and through the sidewall exterior surface (270) such that the line bus distribution prong (430), the ground bus distribution prong (530), the neutral bus distribution prong (630), and the second line bus distribution prong (730) protrude from the sidewall exterior surface (270), and when the distribution base proximal end (3110) and the distribution clamp proximal end (3910) are brought into position substantially against the sidewall (200), (i) the line bus distribution prong (410) enters the distribution line bus prong receiver (3114) so that the line bus distribution prong (410) is in electrical communication with the distribution line bus prong contact end (3410), (ii) the ground bus distribution prong (510) enters the distribution ground bus prong receiver (3115) so that the ground bus distribution prong (510) is in electrical communication with the distribution ground bus contact end (3510), (iii) the neutral bus distribution prong (610) enters the neutral bus prong receiver (3116) so that the neutral bus distribution prong (610) is in electrical communication with the distribution neutral bus contact end (3610), and (iv) the second line bus distribution prong (710) enters the second line bus prong receiver (3117) so that the second line bus distribution prong (710) is in electrical communication with the distribution second line bus contact end (3710).

12. An electrical connection system (50) for electrically connecting a power supply cable (10) to an electrical load (30) where the power supply cable (10) has an insulating sheath (12) enclosing a line conductor (14), a ground conductor (15), a neutral conductor (16), and a second line conductor (17), comprising:

(I) a junction box (100) formed with a bus support surface (110) and at least one sidewall (200) having an interior surface (260) and an exterior surface (270), the junction box (100) houses a line bus (400), a ground bus (500), and a neutral bus (600), wherein, (A) the line bus (400) is formed with a line bus supply prong (410) and a line bus blade connector (420), (B) the ground bus (500) is formed with a ground bus supply prong (510) and a ground bus blade connector (520), and (C) the neutral bus (600) is formed with a neutral bus supply prong (610) and a neutral bus blade connector (620);

(II) a supply connector housing (1000) having a supply connector base (1100) and a supply connector clamp (1900), wherein, (A) the supply connector base (1100) has a supply base proximal end (1110) and a supply base distal end (1120), wherein the supply base distal end (1120) is formed with a supply cable insertion channel (1124), and wherein, the supply connector base (1100) houses a supply line connector (1400), a supply ground connector (1500), and a supply neutral connector (1600), wherein, (i) the supply line connector (1400) has a supply line bus contact end (1410) and a supply line conductor contact end (1420), (ii) the supply ground connector (1500) has a supply ground bus contact end (1510) and a supply ground conductor contact end (1520), and (iii) the supply neutral connector (1600) has a supply neutral bus contact end (1610) and a supply neutral conductor contact end (1620); and (B) when the power supply cable (10) is inserted into the supply cable insertion channel (1124), the line conductor (14) is brought into electrical communication with the supply line conductor contact end (1420), the ground conductor (15) is brought into electrical communication with the supply ground conductor contact end (1520), and the supply neutral conductor (16) is brought into electrical communication with the neutral conductor contact end (1620); and (C) the supply connector clamp (1900) has a supply clamp proximal end (1910) and a supply clamp distal end (1920), wherein the supply connector clamp (1900) releasably cooperates with the supply connector base (1100) such that the line conductor (14), the ground conductor (15), and the neutral conductor (16) are substantially prevented from unintentionally withdrawing from the supply connector housing (1000), and when the supply base proximal end (1110) and the supply clamp proximal end (1910) are brought into position substantially against the sidewall (200), (i) the supply line bus prong contact end (1410) enters the junction box (100) so that the supply line bus prong contact end (1410) is in electrical communication with the line bus supply prong (410), (ii) the supply ground bus contact end (1510) enters the junction box (100) so that the supply ground bus contact end (1510) is in electrical communication with the ground bus supply prong (510), and (iii) the supply neutral bus contact end (1610) enters the junction box (100) so that the supply neutral bus contact end (1610) is in electrical communication with the neutral bus supply prong (610); and (III) a receptacle (2000) formed with a receptacle face (2020) and a receptacle back (2030), wherein the receptacle face (2020) is formed with a line prong receiver (2024), a ground prong receiver (2025), and a neutral prong receiver (2026), and the receptacle (2000) has a line blade (2034), a ground blade (2035), and a neutral blade (2036) that extend from the receptacle back (2030), wherein (A) the line prong receiver (2024) is in electrical communication with the line blade (2034), the ground prong receiver (2025) is in electrical communication with the ground blade (2035), and the neutral prong receiver (2026) is in electrical communication with the neutral blade (2036); and (B) when the receptacle (2000) is inserted into the junction box (100), the line blade (2034) releasably engages, and is in electrical communication with, the line bus blade connector (420); the ground blade (2035) releasably engages, and is in electrical communication with, the ground bus blade connector (520); and the neutral blade (2036) releasably engages, and is in electrical communication with, the neutral bus blade connector (620), whereby electrical continuity exists from the line prong receiver (2024) to the line conductor (14), from the ground prong receiver (2025) to the ground conductor (15), and from the neutral prong receiver (2026) to the neutral conductor (16).

13. The electrical connection system (50) of claim 12, further including a distribution connector housing (3000) having a distribution connector base (3100) and a distribution connector clamp (3900), wherein, (A) the distribution connector base (3100) has a distribution base proximal end (3110) and a distribution base distal end (3120), wherein the distribution base distal end (3120) is formed with a distribution cable insertion channel (3124), and the distribution connector base (3100) houses a distribution line connector (3400), a distribution ground connector (3500), and a distribution neutral connector (3600), wherein, (i) the distribution line connector (3400) has a distribution line bus contact end (3410) and a distribution line conductor contact end (3420), (ii) the distribution ground connector (3500) has a distribution ground bus contact end (3510) and a distribution ground conductor contact end (3520), and (iii) the distribution neutral connector (3600) has a distribution neutral bus contact end (3610) and a distribution neutral conductor contact end (3620); and (iv) when a power distribution cable (20) having a distribution line conductor (24), a distribution ground conductor (25), and a distribution neutral conductor (26) is brought into the distribution cable insertion channel (3124), the distribution line conductor (24) is brought into electrical communication with the distribution line conductor contact end (3420), the ground conductor (25) is brought into electrical communication with the distribution ground conductor contact end (3520), and the distribution neutral conductor (26) is inserted into electrical communication with the distribution neutral conductor contact end (3620); and (B) the distribution connector clamp (3900) has a distribution clamp proximal end (3910) and a distribution clamp distal end (3920), wherein the distribution connector clamp (3900) releasably attached to the distribution connector base (3100) such that the distribution line conductor (24), the distribution ground conductor (25), and the distribution neutral conductor (26) are substantially prevented from unintentionally withdrawing from the distribution connector housing (3000); and (C) the line bus (400) is formed with a line bus distribution prong (430), the ground bus (500) is formed with a ground bus distribution prong (530), and the neutral bus (600) is formed with a neutral bus distribution prong (630), when the distribution base proximal end (3110) and the distribution clamp proximal end (3910) are brought into position substantially against the sidewall (200), (i) the distribution line bus prong contact end (3410) enters the junction box (100) so that the distribution line bus prong contact end (3410) is in electrical communication with the line bus distribution prong (410), (ii) the distribution ground bus contact end (3510) enters the junction box (100) so that the distribution ground bus contact end (3510) is in electrical communication with the ground bus distribution prong (510), and (iii) the distribution neutral bus contact end (3610) enters the junction box (100) so that the distribution neutral bus contact end (3610) is in electrical communication with the neutral bus distribution prong (610).

14. An electrical connection system (50) for electrically connecting a power supply cable (10) to an electrical load (30) where the power supply cable (10) has an insulating sheath (12) enclosing a line conductor (14), a ground conductor (15), a neutral conductor (16), and a second line conductor (17), comprising:

(I) a junction box (100) formed with a bus support surface (110) and at least one sidewall (200) having an interior surface (260) and an exterior surface (270), the junction box (100) is formed with a supply connector shroud (300) having a supply connector rim (310), and the junction box (100) is formed with a distribution connector shroud (900) having a distribution connector rim (910), the junction box (100) houses a line bus (400), a ground bus (500), and a neutral bus (600), wherein, (A) the line bus (400) is formed with a line bus supply prong (410), a line bus blade connector (420), and a line bus distribution prong (430);

(B) the ground bus (500) is formed with a ground bus supply prong (510), a ground bus blade connector (520), and a ground bus distribution prong (530); and (C) the neutral bus (600) is formed with a neutral bus supply prong (610), a neutral bus blade connector (620), and a neutral bus distribution prong (630); and wherein, (D) the line bus (400), the ground bus (500) and the neutral bus (600) penetrate the junction box sidewall (200) passing through the sidewall interior surface (260) and through the sidewall exterior surface (270) such that the line bus supply prong (410), the ground bus supply prong (510), and the neutral bus supply prong (610) protrude from the sidewall exterior surface (270) within the supply connector rim (310), and (E) the line bus (400), the ground bus (500) and the neutral bus (600) penetrate the junction box sidewall (200) passing through the sidewall interior surface (260) and through the sidewall exterior surface (270) such that the line bus distribution prong (430), the ground bus distribution prong (530), and the neutral bus distribution prong (630) protrude from the sidewall exterior surface (270) within the distribution connector rim (910);

(II) a supply connector housing (1000) having a supply connector base (1100) and a supply connector clamp (1900), wherein, (A) the supply connector base (1100) has a supply base proximal end (1110) and a supply base distal end (1120), wherein the supply base proximal end (1110) is formed with a supply line bus prong receiver (1114), a supply ground bus prong receiver (1115), and a supply neutral bus prong receiver (1116), and the supply base distal end (1120) is formed with a supply cable insertion channel (1124), and wherein, the supply connector base (1100) houses a supply line connector (1400), a supply ground connector (1500), and a supply neutral connector (1600), wherein, (i) the supply line connector (1400) has a supply line bus contact end (1410) and a supply line conductor contact end (1420), (ii) the supply ground connector (1500) has a supply ground bus contact end (1510) and a supply ground conductor contact end (1520), and (iii) the supply neutral connector (1600) has a supply neutral bus contact end (1610) and a supply neutral conductor contact end (1620), and (iv) when the power supply cable (10) is inserted into the supply cable insertion channel (1124), the line conductor (14) is brought into electrical communication with the supply line conductor contact end (1420), the ground conductor (15) is brought into electrical communication with the supply ground conductor contact end (1520), and the supply neutral conductor (16) is brought into electrical communication with the neutral conductor contact end (1620); and (B) the supply connector clamp (1900) has a supply clamp proximal end (1910) and a supply clamp distal end (1920), the supply connector clamp (1900) releasably cooperates with the supply connector base (1100) such that the line conductor (14), the ground conductor (15), and the neutral conductor (16) are substantially prevented from unintentionally withdrawing from the supply connector housing (1000), and when the supply base proximal end (1110) and the supply clamp proximal end (1910) are brought into position substantially against the sidewall (200), (i) the line bus supply prong (410) enters the supply line bus prong receiver (1114) so that the line bus supply prong (410) is in electrical communication with the supply line bus prong contact end (1410), (ii) the ground bus supply prong (510) enters the supply ground bus prong receiver (1115) so that the ground bus supply prong (510) is in electrical communication with the supply ground bus contact end (1510), and (iii) the neutral bus supply prong (610) enters the neutral bus prong receiver (1116) so that the neutral bus supply prong (610) is in electrical communication with the supply neutral bus contact end (1610);

(III) a distribution connector housing (3000) having a distribution connector base (3100) and a distribution connector clamp (3900), wherein, (A) the distribution connector base (3100) has a distribution base proximal end (3110) and a distribution base distal end (3120), wherein the distribution base proximal end (3110) is formed with a distribution line bus prong receiver (3114), a distribution ground bus prong receiver (3115), and a distribution neutral bus prong receiver (3116), and the distribution base distal end (3120) is formed with a distribution cable insertion channel (3124), and the distribution connector base (3100) houses a distribution line connector (3400), a distribution ground connector (3500), and a distribution neutral connector (3600), wherein, (i) the distribution line connector (3400) has a distribution line bus contact end (3410) and a distribution line conductor contact end (3420), (ii) the distribution ground connector (3500) has a distribution ground bus contact end (3510) and a distribution ground conductor contact end (3520), (iii) the distribution neutral connector (3600) has a distribution neutral bus contact end (3610) and a distribution neutral conductor contact end (3620), and (iv) when a power distribution cable (20) having a distribution line conductor (24), a distribution ground conductor (25), and a distribution neutral conductor (26) is inserted into the distribution cable insertion channel (3124), the distribution line conductor (24) is brought into electrical communication with the distribution line conductor contact end (3420), the ground conductor (25) is brought into electrical communication with the distribution ground conductor contact end (3520), and the distribution neutral conductor (26) is brought into electrical communication with the distribution neutral conductor contact end (3620); and (B) the distribution connector clamp (3900) has a distribution clamp proximal end (3910) and a distribution clamp distal end (3920), wherein the distribution connector clamp (3900) is fastened to the distribution connector base (3100) such that the distribution line conductor (24), the distribution ground conductor (25), and the distribution neutral conductor (26) are substantially prevented from unintentionally withdrawing from the distribution connector housing (3000), and when the distribution connector housing (3000) is inserted into the distribution connector shroud (900), (i) the line bus distribution prong (410) enters the distribution line bus prong receiver (3114) so that the line bus distribution prong (410) is in electrical communication with the distribution line bus prong contact end (3410), (ii) the ground bus distribution prong (510) enters the distribution ground bus prong receiver (3115) so that the ground bus distribution prong (510) is in electrical communication with the distribution ground bus contact end (3510), (iii) the neutral bus distribution prong (610) enters the neutral bus prong receiver (3116) so that the neutral bus distribution prong (610) is in electrical communication with the distribution neutral bus contact end (3610), and (iv) the distribution connector retaining prong (3950) releasably engages the distribution connector retaining prong catch (940) substantially preventing the unintentional withdrawal of the distribution connector housing (3000) from the distribution connector shroud (900); and (IV) a receptacle (2000) formed with a receptacle face (2020) and a receptacle back (2030), wherein the receptacle face (2020) is formed with a line prong receiver (2024), a ground prong receiver (2025), and a neutral prong receiver (2026), and the receptacle (2000) has a line blade (2034), a ground blade (2035), and a neutral blade (2036) that extend from the receptacle back (2030), wherein (A) the line prong receiver (2024) is in electrical communication with the line blade (2034), the ground prong receiver (2025) is in electrical communication with the ground blade (2035), and the neutral prong receiver (2026) is in electrical communication with the neutral blade (2036); and (B) when the receptacle (2000) is inserted into the junction box (100), the line blade (2034) releasably engages, and is in electrical communication with, the line bus blade connector (420); the ground blade (2035) releasably engages, and is in electrical communication with, the ground bus blade connector (520); and the neutral blade (2036) releasably engages, and is in electrical communication with, the neutral bus blade connector (620), whereby electrical continuity exists from the line prong receiver (2024) to the line conductor (14) and to the distribution line conductor (24), from the ground prong receiver (2025) to the ground conductor (15) and to the distribution ground conductor (25), and from the neutral prong receiver (2026) to the neutral conductor (16) and to the neutral conductor (26), and the receptacle retaining prong (2040) releasably engages the receptacle retaining prong catch (280) substantially preventing the receptacle (2000) from being unintentionally withdrawn from the junction box (100).

15. The electrical connection system (50) of claim 14, wherein the sidewall (200) is formed with a receptacle retaining prong catch (280) and the receptacle has a receptacle retaining prong (2040), the supply connector shroud (300) is formed with a supply connector retaining prong catch (340) and the supply connector housing (1000) is has a supply connector retaining prong (1950), the distribution connector shroud (900) is formed with a distribution connector retaining prong catch (940) and the distribution connector housing (3000) has a distribution connector retaining prong (3950), wherein when (A) the supply connector housing (1000) is inserted into the supply connector shroud (300), the supply connector retaining prong (1950) releasably engages the supply connector retaining prong catch (340);

(B) the distribution connector housing (3000) is inserted into the distribution connector shroud (900), the distribution connector retaining prong (3950) releasably engages the distribution connector retaining prong catch (340); and (C) the receptacle (2000) is inserted into the junction box (100), the receptacle retaining prong (2040) releasably engages the receptacle retaining prong catch (280).

16. The electrical connection system (50) of claim 14, wherein the sidewall (200) is formed with a receptacle alignment fixture (262) and the receptacle (2000) is formed with an alignment recess (2050), such that when the receptacle (2000) is inserted into the junction box (100), the receptacle alignment fixture (262) cooperates with the alignment recess (2050) substantially guiding the line blade (2034), the ground blade (2035), and the neutral blade (2036) into position.

17. The electrical connection system (50) of claim 14, wherein the junction box (100) further includes a second line bus (700), the supply connector base (1100) further includes a supply second line connector (1700), and the supply base proximal end (1110) is formed with a supply second line bus prong receiver (1117), wherein (A) the second line bus (700) has a second line bus supply prong (710) and a second line bus blade connector (720) penetrates the junction box sidewall (200) passing through the sidewall interior surface (260) and through the sidewall exterior surface (270) such that the second line bus supply prong (710) protrudes from the sidewall exterior surface (270), and (B) the supply second line connector (1700) has a supply second line bus contact end (1710) and a supply second line conductor contact end (1720), and (C) when the power supply cable (10) is inserted into the supply cable insertion channel (1124), the second line conductor (17) is brought into electrical communication with the supply second line conductor contact end (1720); and the supply second line conductor (17) is substantially prevented from unintentionally withdrawing from the supply connector housing (1000), and (D) when the supply base proximal end (1110) and the supply clamp proximal end (1910) are brought into position substantially against the sidewall (200), the second line bus supply prong (710) enters the supply line bus prong receiver (1117) so that the second line bus supply prong (710) is in electrical communication with the supply second line bus prong contact end (1710).

18. The electrical connection system (50) of claim 17, wherein (A) the second line bus (700) has a second line bus distribution prong (730), and wherein the second line bus (700) penetrate the junction box sidewall (200) passing through the sidewall interior surface (260) and through the sidewall exterior surface (270) such that the second line bus distribution prong (730) protrudes from the sidewall exterior surface (270), (B) the distribution connector housing (3000) is formed with a distribution second line bus prong receiver (3117), and the distribution connector base (3100) houses a distribution second line connector (3700), wherein, (i) the distribution second line connector (3700) has a distribution second line bus contact end (3710) and a distribution second line conductor contact end (3720), wherein the distribution second line bus contact end (3710) substantially aligns with the distribution second line bus prong receiver (3117), and the distribution second line conductor contact end (3720) is substantially aligned with the distribution cable insertion channel (3124); and (ii) when the power distribution cable (20) is inserted into the distribution cable insertion channel (3124), the distribution second line conductor (27) is brought into electrical communication with the distribution second line conductor contact end (3720); and (C) the distribution second line conductor (27) is substantially prevented from withdrawing from the distribution connector housing (3000), wherein, the distribution base proximal end (3110) and the distribution clamp proximal end (3910) are brought into position substantially against the sidewall (200) whereby, the second line bus distribution prong (710) enters the second line bus prong receiver (3117) so that the second line bus distribution prong (710) is in electrical communication with the distribution second line bus contact end (3710).

19. The electrical connection system (50) of claim 17, wherein the receptacle (2000) further includes a second line prong receiver (2027) and a second line blade (2037), wherein when the receptacle (2000) is inserted into the junction box (100) the second line blade (2037) releasably engages, and is in electrical communication with, the second line bus blade connector (720) such that electrical continuity substantially exists between the second line conductor (17) and the second line prong receiver (2027).

20. The electrical connection system (50) of claim 19, wherein the bus support surface (110) is formed with a line bus blade alignment fixture (160), a ground bus blade alignment fixture (170), a neutral bus blade alignment fixture (180), and a second line bus blade alignment fixture (190), wherein when the receptacle (2000) is inserted into the junction box (100), (A) the line blade (2034) releasably engages the line bus blade alignment fixture (160) and the line blade (2034) is held in electrical communication with the line bus blade connector (420) by the line blade alignment fixture (160), (B) the ground blade (2035) releasably engages the ground blade alignment fixture (170) and the ground blade (2035) is held in electrical communication with the ground bus blade connector (520) by the ground blade alignment fixture (170), (C) the neutral blade (2036) releasably engages the neutral blade alignment fixture (180) and the neutral blade (2036) is held in electrical communication with the neutral bus blade connector (620) by the neutral blade alignment fixture (180), and (D) the second line blade (2037) releasably engages the second line bus blade alignment fixture (190) and the second line blade (2037) is held in electrical communication with the second line bus blade connector (720) by the second line bus blade alignment fixture (190).

* * * * *